US009781969B2

(12) United States Patent
Wright

(10) Patent No.: US 9,781,969 B2
(45) **Date of Patent: *Oct. 10, 2017**

(54) ARTICLE OF FOOTWEAR HAVING AN INTEGRALLY FORMED AUXETIC STRUCTURE

(71) Applicant: NIKE, Inc., Beaverton, OR (US)

(72) Inventor: Zachary C. Wright, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 35 days.

This patent is subject to a terminal disclaimer.

(21) Appl. No.: 14/990,178

(22) Filed: Jan. 7, 2016

(65) Prior Publication Data

US 2016/0219975 A1 Aug. 4, 2016

Related U.S. Application Data

(60) Provisional application No. 62/109,265, filed on Jan. 29, 2015.

(51) Int. Cl.

| | |
|---|---|
| ***A43B 5/00*** | (2006.01) |
| ***A43B 13/18*** | (2006.01) |
| ***A43C 15/16*** | (2006.01) |
| ***A43C 13/04*** | (2006.01) |
| ***A43B 3/00*** | (2006.01) |
| ***A43B 13/12*** | (2006.01) |

(Continued)

(52) U.S. Cl.

CPC ..... *A43B 13/181* (2013.01); *A43B 3/0073* (2013.01); *A43B 5/00* (2013.01); *A43B 13/04* (2013.01); *A43B 13/122* (2013.01); *A43B 13/14* (2013.01); *A43B 13/141* (2013.01); *A43B 13/223* (2013.01); *A43C 13/04* (2013.01); *A43C 15/16* (2013.01)

(58) Field of Classification Search

CPC ..... A43B 1/00; A43B 3/0073; A43B 5/00; A43B 13/02; A43B 13/12; A43B 13/122; A43B 13/187; A43C 13/04; A43C 15/16

USPC ..... 36/25 R, 31, 59 R, 59 C

See application file for complete search history.

(56) References Cited

U.S. PATENT DOCUMENTS 4,439,936 A * 4/1984 Clarke ..... A43B 5/06 36/102

4,445,286 A 5/1984 Norton (Continued)

FOREIGN PATENT DOCUMENTS

DE 3521141 A1 8/1986
EP 2353425 A1 8/2011

(Continued)

OTHER PUBLICATIONS

International Search Report and Written Opinion for PCT Application No. PCT/US2015/067859, dated Apr. 12, 2016.

(Continued)

*Primary Examiner* — Marie Bays
(74) *Attorney, Agent, or Firm* — Quinn IP Law

(57) ABSTRACT

A sole structure that includes at least one auxetic structure and methods of making are disclosed. A sole structure includes a sole having an upper surface and a base surface. The base surface includes a ground contacting surface and a base surface. The base surface is closer to the upper surface than the ground contacting surface. An auxetic structure is integrally formed into the base surface.

10 Claims, 10 Drawing Sheets

(51) Int. Cl.

| | |
|---|---|
| ***A43B 13/14*** | (2006.01) |
| ***A43B 13/22*** | (2006.01) |
| ***A43B 13/04*** | (2006.01) |

(56) References Cited

U.S. PATENT DOCUMENTS

| | | | | |
|---|---|---|---|---|
| 4,446,635 | A | 5/1984 | Hayden, Jr. | |
| 4,454,662 | A * | 6/1984 | Stubblefield | A43B 5/00 36/102 |
| 4,668,557 | A | 5/1987 | Lakes | |
| 5,293,701 | A * | 3/1994 | Sullivan | A43C 15/164 36/114 |
| 5,832,636 | A | 11/1998 | Lyden et al. | |
| 6,161,315 | A * | 12/2000 | Dalton | A43B 13/141 36/134 |
| 6,255,235 | B1 * | 7/2001 | Hiraoka | A41D 19/01547 2/161.3 |
| 6,948,264 | B1 | 9/2005 | Lyden | |
| 7,174,659 | B2 * | 2/2007 | Delgorgue | A43B 13/223 36/31 |
| 7,952,239 | B2 * | 5/2011 | Clark | H01L 41/12 310/26 |
| 8,277,719 | B2 * | 10/2012 | Alderson | B29C 44/357 264/321 |
| 8,375,604 | B2 * | 2/2013 | Eder | A43B 13/26 36/114 |
| 8,652,602 | B1 | 2/2014 | Dolla | |
| 8,776,403 | B2 * | 7/2014 | Eder | A43B 13/26 36/114 |
| 9,402,439 | B2 * | 8/2016 | Cross | A43B 13/22 |
| 9,456,656 | B2 * | 10/2016 | Cross | A43B 13/181 |
| 9,474,326 | B2 * | 10/2016 | Langvin | A43B 5/00 |
| 9,538,811 | B2 * | 1/2017 | Cross | A43B 13/02 |
| 9,549,590 | B2 * | 1/2017 | Cross | A43B 13/187 |
| 9,554,620 | B2 * | 1/2017 | Cross | B32B 27/065 |
| 9,554,622 | B2 * | 1/2017 | Cross | A43B 13/14 |
| 9,554,624 | B2 * | 1/2017 | Cross | A43B 13/22 |
| 2003/0093922 | A1 * | 5/2003 | Delgorgue | A43B 13/223 36/59 R |
| 2005/0034798 | A1 | 2/2005 | Bright | |
| 2005/0257405 | A1 | 11/2005 | Kilgore | |
| 2006/0180505 | A1 | 8/2006 | Alderson et al. | |
| 2009/0307932 | A1 * | 12/2009 | Kirby | A43B 13/223 36/134 |
| 2010/0299965 | A1 | 12/2010 | Avar et al. | |
| 2011/0247237 | A1 | 10/2011 | Jara et al. | |
| 2011/0247243 | A1 | 10/2011 | Eder et al. | |
| 2012/0227289 | A1 * | 9/2012 | Beers | A43B 3/128 36/25 R |
| 2014/0059897 | A1 * | 3/2014 | Sayed | A43B 13/223 36/59 R |
| 2014/0101816 | A1 | 4/2014 | Toronjo | |
| 2014/0109286 | A1 | 4/2014 | Blakely et al. | |
| 2014/0202042 | A1 | 7/2014 | Berend et al. | |
| 2015/0075033 | A1 * | 3/2015 | Cross | A43B 13/22 36/103 |
| 2015/0075034 | A1 * | 3/2015 | Cross | A43B 13/22 36/103 |
| 2015/0230548 | A1 * | 8/2015 | Cross | A43B 13/187 36/104 |
| 2015/0237957 | A1 * | 8/2015 | Cross | A43B 13/14 36/30 R |
| 2015/0237958 | A1 * | 8/2015 | Cross | A43B 13/181 36/103 |
| 2015/0245683 | A1 * | 9/2015 | Cross | B32B 27/065 36/103 |
| 2015/0245685 | A1 * | 9/2015 | Cross | A43B 13/187 36/104 |
| 2015/0245686 | A1 * | 9/2015 | Cross | A43B 13/02 36/29 |
| 2016/0007681 | A1 * | 1/2016 | Langvin | A43B 5/00 36/103 |
| 2016/0058121 | A1 * | 3/2016 | Langvin | A43B 5/06 36/103 |
| 2016/0095385 | A1 * | 4/2016 | Nordstrom | A43B 13/181 36/29 |
| 2016/0157553 | A1 * | 6/2016 | Cross | A43B 13/023 36/30 R |
| 2016/0157557 | A1 * | 6/2016 | Cross | A43B 13/223 36/25 R |
| 2016/0157558 | A1 * | 6/2016 | Cross | A43B 13/14 36/25 R |
| 2016/0219975 | A1 * | 8/2016 | Wright | A43B 13/14 |
| 2016/0219979 | A1 * | 8/2016 | Wright | A43B 13/14 |
| 2016/0262491 | A1 * | 9/2016 | Cross | A43B 13/14 |
| 2016/0374429 | A1 * | 12/2016 | Langvin | A43B 5/00 36/25 R |
| 2017/0042284 | A1 * | 2/2017 | Lawless | A43B 3/0073 |
| 2017/0042285 | A1 * | 2/2017 | Lawless | A43B 13/181 |
| 2017/0042288 | A1 * | 2/2017 | Lawless | A43B 13/223 |

FOREIGN PATENT DOCUMENTS

| | | | |
|---|---|---|---|
| JP | 2002325601 | A | 12/2002 |
| NO | 2007090245 | A1 | 8/2007 |
| WO | 2007052054 | A1 | 5/2007 |
| WO | 2008115743 | A1 | 9/2008 |
| WO | 2015041796 | A1 | 3/2015 |
| WO | 2016122816 | A1 | 8/2016 |
| WO | 2016122817 | A1 | 8/2016 |

OTHER PUBLICATIONS

International Search Report and Written Opinion for PCT Application No. PCT/US2015/067877, dated Apr. 6, 2016.

* cited by examiner

ARTICLE OF FOOTWEAR HAVING AN INTEGRALLY FORMED AUXETIC STRUCTURE

CROSS-REFERENCE TO RELATED APPLICATIONS

This application claims priority under 35 U.S.C. §119(e) to U.S. Provisional Patent Application No. 62/109,265, entitled "Article of Footwear Having an Integrally Formed Auxetic Structure", and filed on Jan. 29, 2015, which application is hereby incorporated by reference.

FIELD

The present disclosure relates generally to an article of footwear including a boot, and methods of making an article of footwear.

BACKGROUND

Articles of footwear typically have at least two major components, an upper that provides the enclosure for receiving the wearer's foot, and a sole secured to the upper that is the primary contact to the ground or playing surface. The footwear may also use some type of fastening system, for example, laces or straps or a combination of both, to secure the footwear around the wearer's foot. The sole may comprise three layers an inner sole, a midsole and an outer sole. The outer sole is the primary contact to the ground or the playing surface. It generally carries a tread pattern and/or cleats or spikes or other protuberances that provide the wearer of the footwear with improved traction suitable to the particular athletic, work or recreational activity, or to a particular ground surface.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
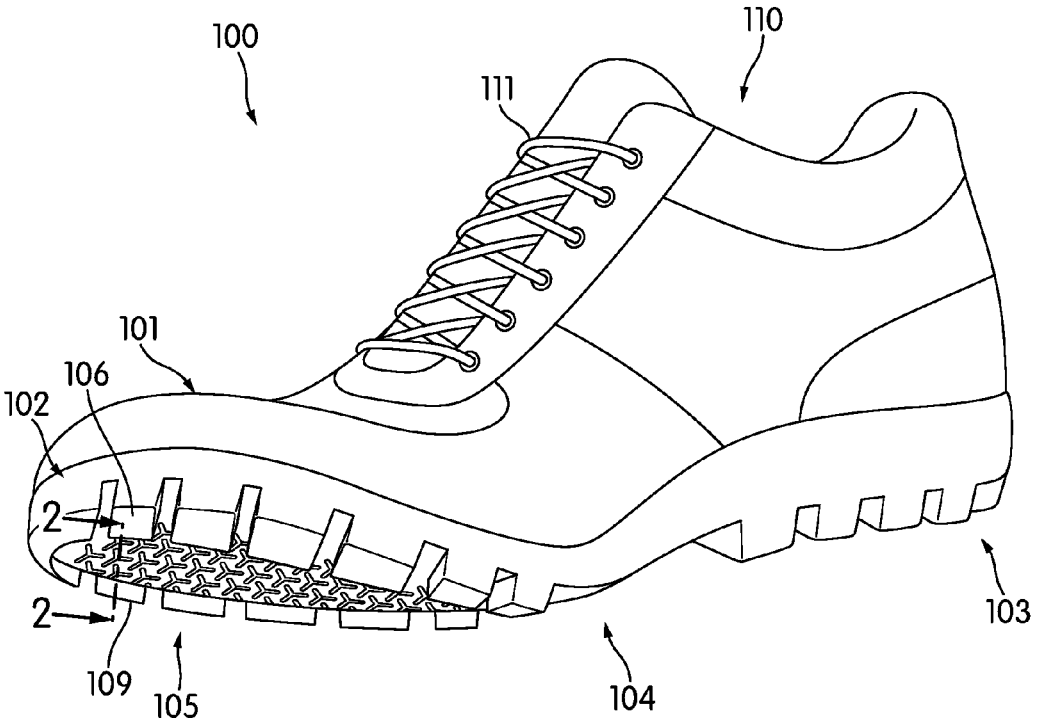
FIG. 1 is an isometric view of an embodiment of an article of footwear with an example of a sole structure with an auxetic structure.

As used herein, the term "auxetic structure" generally refers to a structure that, when it is placed under tension in a first direction, increases its dimensions in a direction that is orthogonal to the first direction. For example, if the structure can be described as having a length, a width and a thickness, then when the structure is under tension longitudinally, it increases in width. In certain of the embodiments, the auxetic structures are bi-directional such that they increase in length and width when stretched longitudinally and in width and length when stretched laterally, but do not increase in thickness. Such auxetic structures are characterized by having a negative Poisson's ratio. Also, although such structures will generally have at least a monotonic relationship between the applied tension and the increase in the dimension orthogonal to the direction of the tension, that relationship need not be proportional or linear, and in general need only increase in response to increased tension.

The article of footwear includes an upper and a sole. The sole may include an inner sole, a midsole and an outer sole. The sole includes at least one layer made of an auxetic structure. This layer can be referred to as an "auxetic layer." When the person wearing the footwear engages in an activity, such as running, turning, leaping or accelerating, that puts the auxetic layer under increased longitudinal or lateral tension, the auxetic layer increases its length and width and thus provides improved traction, as well as absorbing some of the impact with the playing surface. Moreover, as discussed further, the auxetic structure may reduce an adherence of debris and reduce a weight of debris absorbed by the outer sole. Although the descriptions below only discuss a limited number of types of footwear, embodiments can be adapted for many sport and recreational activities, including tennis and other racquet sports, walking, jogging, running, hiking, handball, training, running or walking on a treadmill, as well as team sports such as basketball, volleyball, lacrosse, field hockey and soccer.

An article of footwear is disclosed. The article of footwear may generally have a sole having an upper surface and a base surface. The base surface may include a ground contacting surface and a base surface. The base surface may be closer to the upper surface than the ground contacting surface. An auxetic structure is integrally formed into the base surface.

The article of footwear including the integrally auxetic structure may be configured such that the auxetic structure includes a tristar-shaped pattern.

The article of footwear including the integrally auxetic structure may be configured such that the auxetic structure includes a tristar-shaped pattern. The tristar-shaped pattern may include a plurality of tristar-shaped voids, each tristar-shaped void comprising a center and three radial segments extending from the center.

The article of footwear including the integrally auxetic structure may be configured such that the auxetic structure includes a tristar-shaped pattern. The tristar-shaped pattern may include a plurality of tristar-shaped voids, each tristar-shaped void comprising a center and three radial segments extending from the center. A first tristar-shaped void of the plurality of tristar-shaped voids may include a first radial segment, a second radial segment, and a third radial segment. The first radial segment, the second radial segment, and the third radial segment may be substantially equal in length.

The article of footwear including the integrally auxetic structure may be configured such that the auxetic structure includes a tristar-shaped pattern. The tristar-shaped pattern may include a plurality of tristar-shaped voids, each tristar-shaped void comprising a center and three radial segments extending from the center. A first tristar-shaped void of the plurality of tristar-shaped voids may include a first radial segment, a second radial segment, and a third radial segment. The first radial segment, the second radial segment, and the third radial segment may be substantially equal in length. The first radial segment may have a first length of between 1/50 and 1/2 of a separation distance between the ground contacting surface and the base surface.

The article of footwear including the integrally auxetic structure may be configured such that the auxetic structure includes a tristar-shaped pattern. The tristar-shaped pattern may include a plurality of tristar-shaped voids, each tristar-shaped void comprising a center and three radial segments extending from the center. A first tristar-shaped void of the plurality of tristar-shaped voids may include a first radial segment, a second radial segment, and a third radial segment. The first radial segment, the second radial segment, and the third radial segment may be substantially equal in length. The first radial segment may have a first central angle with the second radial segment. The first radial segment may have a second central angle with the third radial segment. The first central angle and the second central angle may be substantially equal in length.

The article of footwear including the integrally auxetic structure may be configured such that the auxetic structure includes a tristar-shaped pattern. The tristar-shaped pattern may include a plurality of tristar-shaped voids, each tristar-shaped void comprising a center and three radial segments extending from the center. A first tristar-shaped void of the plurality of tristar-shaped voids may include a first radial segment, a second radial segment, and a third radial segment. The first radial segment, the second radial segment, and the third radial segment may be substantially equal in length. The first radial segment may have a first length of between 1/50 and 1/2 of a separation distance between the ground contacting surface and the base surface. The first radial segment may have a first central angle with the second radial segment. The first radial segment may have a second central angle with the third radial segment. The first central angle and the second central angle may be substantially equal in length.

The article of footwear including the integrally auxetic structure may be configured such that the auxetic structure includes a tristar-shaped pattern. The tristar-shaped pattern may include a plurality of tristar-shaped voids, each tristar-shaped void comprising a center and three radial segments extending from the center. A first tristar-shaped void of the plurality of tristar-shaped voids may include a first radial segment, a second radial segment, and a third radial segment. The first radial segment, the second radial segment, and the third radial segment may be substantially equal in length. The first radial segment may be substantially aligned with a radial segment of another one of the plurality of tristar-shaped voids.

The article of footwear including the integrally auxetic structure may be configured such that the auxetic structure includes a tristar-shaped pattern. The tristar-shaped pattern may include a plurality of tristar-shaped voids, each tristar-shaped void comprising a center and three radial segments extending from the center. A first tristar-shaped void of the plurality of tristar-shaped voids may include a first radial segment, a second radial segment, and a third radial segment. The first radial segment, the second radial segment, and the third radial segment may be substantially equal in length. The first radial segment may have a first length of between 1/50 and 1/2 of a separation distance between the ground contacting surface and the base surface. The first radial segment may be substantially aligned with a radial segment of another one of the plurality of tristar-shaped voids.

The article of footwear including the integrally auxetic structure may be configured such that the auxetic structure includes a tristar-shaped pattern. The tristar-shaped pattern may include a plurality of tristar-shaped voids, each tristar-shaped void comprising a center and three radial segments extending from the center. A first tristar-shaped void of the plurality of tristar-shaped voids may include a first radial segment, a second radial segment, and a third radial segment. The first radial segment, the second radial segment, and the third radial segment may be substantially equal in length. The first radial segment may have a first length of between 1/50 and 1/2 of a separation distance between the ground contacting surface and the base surface. The first radial segment may have a first central angle with the second radial segment. The first radial segment may have a second central angle with the third radial segment. The first central angle and the second central angle may be substantially equal in length. The first radial segment may be substantially aligned with a radial segment of another one of the plurality of tristar-shaped voids.

The article of footwear including the integrally auxetic structure may be configured such that the auxetic structure may include a recessed surface, the recessed surface being spaced closer to the upper surface than the base surface. The auxetic structure may increase a surface area of the base surface by at least five percent in response to a compressive force applied to the auxetic structure. The compressive force may be greater than 1,000 newtons.

The article of footwear including the integrally auxetic structure may be configured such that the auxetic structure includes a tristar-shaped pattern. The tristar-shaped pattern may include a plurality of tristar-shaped voids, each tristar-shaped void comprising a center and three radial segments extending from the center. A first tristar-shaped void of the plurality of tristar-shaped voids may include a first radial segment, a second radial segment, and a third radial segment. The first radial segment, the second radial segment, and the third radial segment may be substantially equal in length. The first radial segment may have a first length of between 1/50 and 1/2 of a separation distance between the ground contacting surface and the base surface. The first radial segment may have a first central angle with the second radial segment. The first radial segment may have a second central angle with the third radial segment. The first central angle and the second central angle may be substantially equal in length. The first radial segment may be substantially aligned with a radial segment of another one of the plurality of tristar-shaped voids. The auxetic structure may include a recessed surface, the recessed surface being spaced closer to the upper surface than the base surface. The auxetic structure may increase a surface area of the base surface by at least five percent in response to a compressive force applied to the auxetic structure. The compressive force may be greater than 1,000 newtons.

The article of footwear including the integrally auxetic structure may be configured such that the auxetic structure may include a recessed surface, the recessed surface being spaced closer to the upper surface than the base surface. The auxetic structure may increase a surface area of the base surface by at least five percent in response to a compressive force applied to the auxetic structure. The compressive force may be greater than 1,000 newtons. The compressive force may result in a first increase in a first surface area of a first portion of the base surface. The compressive force may result in a second increase in a second surface area of a second portion of the base surface. The first increase may be at least five percent greater than the second increase.

The article of footwear including the integrally auxetic structure may be configured such that the auxetic structure may include a recessed surface, the recessed surface being spaced closer to the upper surface than the base surface. The auxetic structure may increase a surface area of the base surface by at least five percent in response to a compressive force applied to the auxetic structure. The compressive force may be greater than 1,000 newtons. The compressive force may result in a first increase in a first surface area of a first portion of the base surface. The compressive force may result in a second increase in a second surface area of a second portion of the base surface. The first increase may be at least five percent greater than the second increase. The auxetic structure has a thickness of 1/50 to 1/2 a separation distance between the ground contacting surface and the base surface.

The article of footwear including the integrally auxetic structure may be configured such that the sole may have a first ground contacting element and a second ground contacting element. The auxetic structure may separate the first ground contacting element and the second ground contacting element. The first ground contacting element may have a first ground contacting surface. The second ground contacting element may have a second ground contacting surface. The first ground contacting surface and the second ground contacting surface may form the ground contacting surface. The auxetic structure may include a recessed surface. The recessed surface may be spaced closer to the upper surface than the base surface. The auxetic structure may increase a surface area of the base surface in response to a compressive force applied to the auxetic structure reducing a separation distance between the recessed surface and the base surface.

The article of footwear including the integrally auxetic structure may be configured such that the auxetic structure includes a tristar-shaped pattern. The tristar-shaped pattern may include a plurality of tristar-shaped voids, each tristar-shaped void comprising a center and three radial segments extending from the center. A first tristar-shaped void of the plurality of tristar-shaped voids may include a first radial segment, a second radial segment, and a third radial segment. The first radial segment, the second radial segment, and the third radial segment may be substantially equal in length. The first radial segment may have a first length of between 1/50 and 1/2 of a separation distance between the ground contacting surface and the base surface. The first radial segment may have a first central angle with the second radial segment. The first radial segment may have a second central angle with the third radial segment. The first central angle and the second central angle may be substantially equal in length. The first radial segment may be substantially aligned with a radial segment of another one of the plurality of tristar-shaped voids. The sole may have a first ground contacting element and a second ground contacting element. The auxetic structure may separate the first ground contacting element and the second ground contacting element. The first ground contacting element may have a first ground contacting surface. The second ground contacting element may have a second ground contacting surface. The first ground contacting surface and the second ground contacting surface may form the ground contacting surface. The auxetic structure may include a recessed surface. The recessed surface may be spaced closer to the upper surface than the base surface. The auxetic structure may increase a surface area of the base surface in response to a compressive force applied to the auxetic structure reducing a separation distance between the recessed surface and the base surface.

The article of footwear including the integrally auxetic structure may be configured such that the auxetic structure may include a recessed surface, the recessed surface being spaced closer to the upper surface than the base surface. The auxetic structure may increase a surface area of the base surface by at least five percent in response to a compressive force applied to the auxetic structure. The compressive force may be greater than 1,000 newtons. The compressive force may result in a first increase in a first surface area of a first portion of the base surface. The compressive force may result in a second increase in a second surface area of a second portion of the base surface. The first increase may be at least five percent greater than the second increase. The auxetic structure has a thickness of 1/50 to 1/2 a separation distance between the ground contacting surface and the base surface. The sole may have a first ground contacting element and a second ground contacting element. The auxetic structure may separate the first ground contacting element and the second ground contacting element. The first ground contacting element may have a first ground contacting surface. The second ground contacting element may have a second ground contacting surface. The first ground contacting surface and the second ground contacting surface may form the ground contacting surface. The auxetic structure may include a recessed surface. The recessed surface may be spaced closer to the upper surface than the base surface. The auxetic structure may increase a surface area of the base surface in response to a compressive force applied to the auxetic structure reducing a separation distance between the recessed surface and the base surface.

The article of footwear including the integrally auxetic structure may be configured such that the sole may have a first ground contacting element and a second ground contacting element. The auxetic structure may separate the first ground contacting element and the second ground contacting element. The first ground contacting element may have a first ground contacting surface. The second ground contacting element may have a second ground contacting surface. The first ground contacting surface and the second ground contacting surface may form the ground contacting surface. The auxetic structure may include a recessed surface. The recessed surface may be spaced closer to the upper surface than the base surface. The auxetic structure may increase a surface area of the base surface in response to a compressive force applied to the auxetic structure reducing a separation distance between the recessed surface and the base surface. The auxetic structure may be constrained between the first ground contacting element and the second ground contacting element. The auxetic structure may be configured to move in a first direction, the first direction being normal to the bottom surface. The auxetic structure may be configured to move in a second direction, the second direction being perpendicular to the first direction.

The article of footwear including the integrally auxetic structure may be configured such that the auxetic structure includes a tristar-shaped pattern. The tristar-shaped pattern may include a plurality of tristar-shaped voids, each tristar-shaped void comprising a center and three radial segments extending from the center. A first tristar-shaped void of the plurality of tristar-shaped voids may include a first radial segment, a second radial segment, and a third radial segment. The first radial segment, the second radial segment, and the third radial segment may be substantially equal in length. The first radial segment may have a first length of between 1/50 and 1/2 of a separation distance between the ground contacting surface and the base surface. The first radial segment may have a first central angle with the second radial segment. The first radial segment may have a second central angle with the third radial segment. The first central angle and the second central angle may be substantially equal in length. The first radial segment may be substantially aligned with a radial segment of another one of the plurality of tristar-shaped voids. The sole may have a first ground contacting element and a second ground contacting element. The auxetic structure may separate the first ground contacting element and the second ground contacting element. The first ground contacting element may have a first ground contacting surface. The second ground contacting element may have a second ground contacting surface. The first ground contacting surface and the second ground contacting surface may form the ground contacting surface. The auxetic structure may include a recessed surface. The recessed surface may be spaced closer to the upper surface than the base surface. The auxetic structure may increase a surface area of the base surface in response to a compressive force applied to the auxetic structure reducing a separation distance between the recessed surface and the base surface. The auxetic structure may be constrained between the first ground contacting element and the second ground contacting element. The auxetic structure may be configured to move in a first direction, the first direction being normal to the bottom surface. The auxetic structure may be configured to move in a second direction, the second direction being perpendicular to the first direction.

The article of footwear including the integrally auxetic structure may be configured such that the auxetic structure may include a recessed surface, the recessed surface being spaced closer to the upper surface than the base surface. The auxetic structure may increase a surface area of the base surface by at least five percent in response to a compressive force applied to the auxetic structure. The compressive force may be greater than 1,000 newtons. The compressive force may result in a first increase in a first surface area of a first portion of the base surface. The compressive force may result in a second increase in a second surface area of a second portion of the base surface. The first increase may be at least five percent greater than the second increase. The auxetic structure has a thickness of 1/50 to 1/2 a separation distance between the ground contacting surface and the base surface. The sole may have a first ground contacting element and a second ground contacting element. The auxetic structure may separate the first ground contacting element and the second ground contacting element. The first ground contacting element may have a first ground contacting surface. The second ground contacting element may have a second ground contacting surface. The first ground contacting surface and the second ground contacting surface may form the ground contacting surface. The auxetic structure may include a recessed surface. The recessed surface may be spaced closer to the upper surface than the base surface. The auxetic structure may increase a surface area of the base surface in response to a compressive force applied to the auxetic structure reducing a separation distance between the recessed surface and the base surface. The auxetic structure may be constrained between the first ground contacting element and the second ground contacting element. The auxetic structure may be configured to move in a first direction, the first direction being normal to the bottom surface. The auxetic structure may be configured to move in a second direction, the second direction being perpendicular to the first direction.

The article of footwear including the integrally auxetic structure may be configured such that the sole may have a first ground contacting element and a second ground contacting element. The auxetic structure may separate the first ground contacting element and the second ground contacting element. The first ground contacting element may have a first ground contacting surface. The second ground contacting element may have a second ground contacting surface. The first ground contacting surface and the second ground contacting surface may form the ground contacting surface. The auxetic structure may include a recessed surface. The recessed surface may be spaced closer to the upper surface than the base surface. The auxetic structure may increase a surface area of the base surface in response to a compressive force applied to the auxetic structure reducing a separation distance between the recessed surface and the base surface. The auxetic structure may be constrained between the first ground contacting element and the second ground contacting element. The auxetic structure may be configured to move in a first direction, the first direction being normal to the bottom surface. The auxetic structure may be configured to move in a second direction, the second direction being perpendicular to the first direction. The upper surface may be attached to an upper of an article of footwear.

The article of footwear including the integrally auxetic structure may be configured such that the auxetic structure includes a tristar-shaped pattern. The tristar-shaped pattern may include a plurality of tristar-shaped voids, each tristar-shaped void comprising a center and three radial segments extending from the center. A first tristar-shaped void of the plurality of tristar-shaped voids may include a first radial segment, a second radial segment, and a third radial segment. The first radial segment, the second radial segment, and the third radial segment may be substantially equal in length. The first radial segment may have a first length of between 1/50 and 1/2 of a separation distance between the ground contacting surface and the base surface. The first radial segment may have a first central angle with the second radial segment. The first radial segment may have a second central angle with the third radial segment. The first central angle and the second central angle may be substantially equal in length. The first radial segment may be substantially aligned with a radial segment of another one of the plurality of tristar-shaped voids. The sole may have a first ground contacting element and a second ground contacting element. The auxetic structure may separate the first ground contacting element and the second ground contacting element. The first ground contacting element may have a first ground contacting surface. The second ground contacting element may have a second ground contacting surface. The first ground contacting surface and the second ground contacting surface may form the ground contacting surface. The auxetic structure may include a recessed surface. The recessed surface may be spaced closer to the upper surface than the base surface. The auxetic structure may increase a surface area of the base surface in response to a compressive force applied to the auxetic structure reducing a separation distance between the recessed surface and the base surface. The auxetic structure may be constrained between the first ground contacting element and the second ground contacting element. The auxetic structure may be configured to move in a first direction, the first direction being normal to the bottom surface. The auxetic structure may be configured to move in a second direction, the second direction being perpendicular to the first direction. The upper surface may be attached to an upper of an article of footwear.

The article of footwear including the integrally auxetic structure may be configured such that the auxetic structure may include a recessed surface, the recessed surface being spaced closer to the upper surface than the base surface. The auxetic structure may increase a surface area of the base surface by at least five percent in response to a compressive force applied to the auxetic structure. The compressive force may be greater than 1,000 newtons. The compressive force may result in a first increase in a first surface area of a first portion of the base surface. The compressive force may result in a second increase in a second surface area of a second portion of the base surface. The first increase may be at least five percent greater than the second increase. The auxetic structure has a thickness of 1/50 to 1/2 a separation distance between the ground contacting surface and the base surface. The sole may have a first ground contacting element and a second ground contacting element. The auxetic structure may separate the first ground contacting element and the second ground contacting element. The first ground contacting element may have a first ground contacting surface. The second ground contacting element may have a second ground contacting surface. The first ground contacting surface and the second ground contacting surface may form the ground contacting surface. The auxetic structure may include a recessed surface. The recessed surface may be spaced closer to the upper surface than the base surface. The auxetic structure may increase a surface area of the base surface in response to a compressive force applied to the auxetic structure reducing a separation distance between the recessed surface and the base surface. The auxetic structure may be constrained between the first ground contacting element and the second ground contacting element. The auxetic structure may be configured to move in a first direction, the first direction being normal to the bottom surface. The auxetic structure may be configured to move in a second direction, the second direction being perpendicular to the first direction. The upper surface may be attached to an upper of an article of footwear.

The article of footwear including the integrally auxetic structure may be configured such that the sole may have a first ground contacting element and a second ground contacting element. The auxetic structure may separate the first ground contacting element and the second ground contacting element. The first ground contacting element may have a first ground contacting surface. The second ground contacting element may have a second ground contacting surface. The first ground contacting surface and the second ground contacting surface may form the ground contacting surface. The auxetic structure may include a recessed surface. The recessed surface may be spaced closer to the upper surface than the base surface. The auxetic structure may increase a surface area of the base surface in response to a compressive force applied to the auxetic structure reducing a separation distance between the recessed surface and the base surface. The auxetic structure may be constrained between the first ground contacting element and the second ground contacting element. The auxetic structure may be configured to move in a first direction, the first direction being normal to the bottom surface. The auxetic structure may be configured to move in a second direction, the second direction being perpendicular to the first direction. The upper surface may be attached to an upper of an article of footwear. An adherence of debris onto the base surface may be at least 15% less than an adherence of debris onto a control sole. The control sole may be identical to the sole structure except that the control sole does not include the auxetic structure. The control sole may include a control base surface without an auxetic structure formed into the control base surface.

The article of footwear including the integrally auxetic structure may be configured such that the auxetic structure includes a tristar-shaped pattern. The tristar-shaped pattern may include a plurality of tristar-shaped voids, each tristar-shaped void comprising a center and three radial segments extending from the center. A first tristar-shaped void of the plurality of tristar-shaped voids may include a first radial segment, a second radial segment, and a third radial segment. The first radial segment, the second radial segment, and the third radial segment may be substantially equal in length. The first radial segment may have a first length of between 1/50 and 1/2 of a separation distance between the ground contacting surface and the base surface. The first radial segment may have a first central angle with the second radial segment. The first radial segment may have a second central angle with the third radial segment. The first central angle and the second central angle may be substantially equal in length. The first radial segment may be substantially aligned with a radial segment of another one of the plurality of tristar-shaped voids. The sole may have a first ground contacting element and a second ground contacting element. The auxetic structure may separate the first ground contacting element and the second ground contacting element. The first ground contacting element may have a first ground contacting surface. The second ground contacting element may have a second ground contacting surface. The first ground contacting surface and the second ground contacting surface may form the ground contacting surface. The auxetic structure may include a recessed surface. The recessed surface may be spaced closer to the upper surface than the base surface. The auxetic structure may increase a surface area of the base surface in response to a compressive force applied to the auxetic structure reducing a separation distance between the recessed surface and the base surface. The auxetic structure may be constrained between the first ground contacting element and the second ground contacting element. The auxetic structure may be configured to move in a first direction, the first direction being normal to the bottom surface. The auxetic structure may be configured to move in a second direction, the second direction being perpendicular to the first direction. The upper surface may be attached to an upper of an article of footwear. An adherence of debris onto the base surface may be at least 15% less than an adherence of debris onto a control sole. The control sole may be identical to the sole structure except that the control sole does not include the auxetic structure. The control sole may include a control base surface without an auxetic structure formed into the control base surface.

The article of footwear including the integrally auxetic structure may be configured such that the auxetic structure may include a recessed surface, the recessed surface being spaced closer to the upper surface than the base surface. The auxetic structure may increase a surface area of the base surface by at least five percent in response to a compressive force applied to the auxetic structure. The compressive force may be greater than 1,000 newtons. The compressive force may result in a first increase in a first surface area of a first portion of the base surface. The compressive force may result in a second increase in a second surface area of a second portion of the base surface. The first increase may be at least five percent greater than the second increase. The auxetic structure has a thickness of 1/50 to 1/2 a separation distance between the ground contacting surface and the base surface. The sole may have a first ground contacting element and a second ground contacting element. The auxetic structure may separate the first ground contacting element and the second ground contacting element. The first ground contacting element may have a first ground contacting surface. The second ground contacting element may have a second ground contacting surface. The first ground contacting surface and the second ground contacting surface may form the ground contacting surface. The auxetic structure may include a recessed surface. The recessed surface may be spaced closer to the upper surface than the base surface. The auxetic structure may increase a surface area of the base surface in response to a compressive force applied to the auxetic structure reducing a separation distance between the recessed surface and the base surface. The auxetic structure may be constrained between the first ground contacting element and the second ground contacting element. The auxetic structure may be configured to move in a first direction, the first direction being normal to the bottom surface. The auxetic structure may be configured to move in a second direction, the second direction being perpendicular to the first direction. The upper surface may be attached to an upper of an article of footwear. An adherence of debris onto the base surface may be at least 15% less than an adherence of debris onto a control sole. The control sole may be identical to the sole structure except that the control sole does not include the auxetic structure. The control sole may include a control base surface without an auxetic structure formed into the control base surface.

The article of footwear including the integrally auxetic structure may be configured such that the sole may have a first ground contacting element and a second ground contacting element. The auxetic structure may separate the first ground contacting element and the second ground contacting element. The first ground contacting element may have a first ground contacting surface. The second ground contacting element may have a second ground contacting surface. The first ground contacting surface and the second ground contacting surface may form the ground contacting surface. The auxetic structure may include a recessed surface. The recessed surface may be spaced closer to the upper surface than the base surface. The auxetic structure may increase a surface area of the base surface in response to a compressive force applied to the auxetic structure reducing a separation distance between the recessed surface and the base surface. The auxetic structure may be constrained between the first ground contacting element and the second ground contacting element. The auxetic structure may be configured to move in a first direction, the first direction being normal to the bottom surface. The auxetic structure may be configured to move in a second direction, the second direction being perpendicular to the first direction. The upper surface may be attached to an upper of an article of footwear. An adherence of debris onto the base surface may be at least 15% less than an adherence of debris onto a control sole. The control sole may be identical to the sole structure except that the control sole does not include the auxetic structure. The control sole may include a control base surface without an auxetic structure formed into the control base surface. Following a 30 minute wear test on a wet grass field, a weight of debris adsorbed to the base surface may be at least 15% less than a weight of debris adsorbed to a control sole. The control sole may be identical to the sole structure except that the control sole does not include the auxetic structure. The control sole may include a control base surface without an auxetic structure formed into the control base surface.

The article of footwear including the integrally auxetic structure may be configured such that the auxetic structure includes a tristar-shaped pattern. The tristar-shaped pattern may include a plurality of tristar-shaped voids, each tristar-shaped void comprising a center and three radial segments extending from the center. A first tristar-shaped void of the plurality of tristar-shaped voids may include a first radial segment, a second radial segment, and a third radial segment. The first radial segment, the second radial segment, and the third radial segment may be substantially equal in length. The first radial segment may have a first length of between 1/50 and 1/2 of a separation distance between the ground contacting surface and the base surface. The first radial segment may have a first central angle with the second radial segment. The first radial segment may have a second central angle with the third radial segment. The first central angle and the second central angle may be substantially equal in length. The first radial segment may be substantially aligned with a radial segment of another one of the plurality of tristar-shaped voids. The sole may have a first ground contacting element and a second ground contacting element. The auxetic structure may separate the first ground contacting element and the second ground contacting element. The first ground contacting element may have a first ground contacting surface. The second ground contacting element may have a second ground contacting surface. The first ground contacting surface and the second ground contacting surface may form the ground contacting surface. The auxetic structure may include a recessed surface. The recessed surface may be spaced closer to the upper surface than the base surface. The auxetic structure may increase a surface area of the base surface in response to a compressive force applied to the auxetic structure reducing a separation distance between the recessed surface and the base surface. The auxetic structure may be constrained between the first ground contacting element and the second ground contacting element. The auxetic structure may be configured to move in a first direction, the first direction being normal to the bottom surface. The auxetic structure may be configured to move in a second direction, the second direction being perpendicular to the first direction. The upper surface may be attached to an upper of an article of footwear. An adherence of debris onto the base surface may be at least 15% less than an adherence of debris onto a control sole. The control sole may be identical to the sole structure except that the control sole does not include the auxetic structure. The control sole may include a control base surface without an auxetic structure formed into the control base surface. Following a 30 minute wear test on a wet grass field, a weight of debris adsorbed to the base surface may be at least 15% less than a weight of debris adsorbed to a control sole. The control sole may be identical to the sole structure except that the control sole does not include the auxetic structure. The control sole may include a control base surface without an auxetic structure formed into the control base surface.

The article of footwear including the integrally auxetic structure may be configured such that the auxetic structure may include a recessed surface, the recessed surface being spaced closer to the upper surface than the base surface. The auxetic structure may increase a surface area of the base surface by at least five percent in response to a compressive force applied to the auxetic structure. The compressive force may be greater than 1,000 newtons. The compressive force may result in a first increase in a first surface area of a first portion of the base surface. The compressive force may result in a second increase in a second surface area of a second portion of the base surface. The first increase may be at least five percent greater than the second increase. The auxetic structure has a thickness of 1/50 to 1/2 a separation distance between the ground contacting surface and the base surface. The sole may have a first ground contacting element and a second ground contacting element. The auxetic structure may separate the first ground contacting element and the second ground contacting element. The first ground contacting element may have a first ground contacting surface. The second ground contacting element may have a second ground contacting surface. The first ground contacting surface and the second ground contacting surface may form the ground contacting surface. The auxetic structure may include a recessed surface. The recessed surface may be spaced closer to the upper surface than the base surface. The auxetic structure may increase a surface area of the base surface in response to a compressive force applied to the auxetic structure reducing a separation distance between the recessed surface and the base surface. The auxetic structure may be constrained between the first ground contacting element and the second ground contacting element. The auxetic structure may be configured to move in a first direction, the first direction being normal to the bottom surface. The auxetic structure may be configured to move in a second direction, the second direction being perpendicular to the first direction. The upper surface may be attached to an upper of an article of footwear. An adherence of debris onto the base surface may be at least 15% less than an adherence of debris onto a control sole. The control sole may be identical to the sole structure except that the control sole does not include the auxetic structure. The control sole may include a control base surface without an auxetic structure formed into the control base surface. Following a 30 minute wear test on a wet grass field, a weight of debris adsorbed to the base surface may be at least 15% less than a weight of debris adsorbed to a control sole. The control sole may be identical to the sole structure except that the control sole does not include the auxetic structure. The control sole may include a control base surface without an auxetic structure formed into the control base surface.

A method of manufacturing a sole structure is disclosed. The method of manufacturing a sole structure may generally include forming a sole having an upper surface and a base surface. The base surface may include a ground contacting surface and a base surface. The base surface may be closer to the upper surface than the ground contacting surface. An auxetic structure may be integrally formed into the base surface.

The method including integrally forming an auxetic structure may be configured such that the auxetic structure may include a recessed surface. The recessed surface may be spaced closer to the upper surface than the base surface. The auxetic structure may increase a surface area of the base surface by at least five percent in response to a compressive force applied to the auxetic structure. The compressive force may be greater than 1,000 newtons.

The method including integrally forming an auxetic structure may be configured such that the auxetic structure may include a recessed surface. The recessed surface may be spaced closer to the upper surface than the base surface. The auxetic structure may increase a surface area of the base surface by at least five percent in response to a compressive force applied to the auxetic structure. The compressive force may be greater than 1,000 newtons. The compressive force may result in a first increase in a first surface area of a first portion of the base surface. The compressive force may result in a second increase in a second surface area of a second portion of the base surface. The first increase may be at least five percent greater than the second increase.

A method of manufacturing a sole structure is disclosed. The method of manufacturing a sole structure may generally include forming a sole having an upper surface and a base surface. The base surface may include a ground contacting surface and a base surface. The base surface may be closer to the upper surface than the ground contacting surface. An auxetic structure may be integrally formed into the base surface. The auxetic structure may have a thickness of 1/50 to 1/2 a separation distance between the ground contacting surface and the base surface.

The method including integrally forming an auxetic structure may be configured such that the auxetic structure may include a recessed surface. The recessed surface may be spaced closer to the upper surface than the base surface. The auxetic structure may increase a surface area of the base surface by at least five percent in response to a compressive force applied to the auxetic structure. The compressive force may be greater than 1,000 newtons. The auxetic structure may have a thickness of 1/50 to 1/2 a separation distance between the ground contacting surface and the base surface.

The method including integrally forming an auxetic structure may be configured such that the auxetic structure may include a recessed surface. The recessed surface may be spaced closer to the upper surface than the base surface. The auxetic structure may increase a surface area of the base surface by at least five percent in response to a compressive force applied to the auxetic structure. The compressive force may be greater than 1,000 newtons. The compressive force may result in a first increase in a first surface area of a first portion of the base surface. The compressive force may result in a second increase in a second surface area of a second portion of the base surface. The first increase may be at least five percent greater than the second increase. The auxetic structure may have a thickness of 1/50 to 1/2 a separation distance between the ground contacting surface and the base surface.

The method including integrally forming an auxetic structure may be configured such that the auxetic structure may include a recessed surface. The recessed surface may be spaced closer to the upper surface than the base surface. The auxetic structure may increase a surface area of the base surface by at least five percent in response to a compressive force applied to the auxetic structure. The compressive force may be greater than 1,000 newtons. The compressive force may result in a first increase in a first surface area of a first portion of the base surface. The compressive force may result in a second increase in a second surface area of a second portion of the base surface. The first increase may be at least five percent greater than the second increase. The auxetic structure may have a thickness of 1/50 to 1/2 a separation distance between the ground contacting surface and the base surface. The method including integrally forming an auxetic structure may include providing an upper of an article of footwear and attaching the upper to the upper surface.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

For clarity, the detailed descriptions herein describe certain exemplary embodiments, but the disclosure herein may be applied to any article of footwear comprising certain of the features described herein and recited in the claims. In particular, although the following detailed description discusses exemplary embodiments, in the form of footwear such as running shoes, jogging shoes, tennis, squash or racquetball shoes, basketball shoes, sandals and flippers, the disclosures herein may be applied to a wide range of footwear.

The term "sole structure", also referred to simply as "sole", herein shall refer to any combination that provides support for a wearer's foot and bears the surface that is in direct contact with the ground or playing surface, such as a single sole; a combination of a sole and an inner sole; a combination of a sole, a midsole and an inner sole, and a combination of an outer covering, a sole, a midsole and an inner sole.

FIG. 1 is an isometric view of an embodiment of an article of footwear 100. Article of footwear 100 may include upper 101 and sole structure 102, also referred to hereafter simply as sole 102. Upper 101 has a heel region 103, an instep or midfoot region 104 and a forefoot region 105. Upper 101 may include an opening or throat 110 that allows the wearer to insert his or her foot into the footwear. In some embodiments, upper 101 may also include laces 111, which can be used to tighten or otherwise adjust upper 101 around a foot. The upper 101 may be attached to the sole 102 by any known mechanism or method. For example, upper 101 may be stitched to sole 102 or upper 101 may be glued to sole 102.

The exemplary embodiment shows a generic design for the upper. In some embodiments, the upper may include another type of design. For instance, the upper 101 may be a seamless warp knit tube of mesh. The upper 101 may be made from materials known in the art for making articles of footwear. For example, the upper 101 may be made from nylon, natural leather, synthetic leather, natural rubber, or synthetic rubber.

The sole 102 may be made from materials known in the art for making articles of footwear. For example, the sole 102 may be made from natural rubber, polyurethane, or polyvinyl chloride (PVC) compounds, and the like. The sole may be provided by various techniques know in the art. In some embodiments, the sole 102 may be provided as prefabricated. In other embodiments, the sole 102 may be provided by, for example, molding the sole 102 in a molding cavity.

Figure 2:
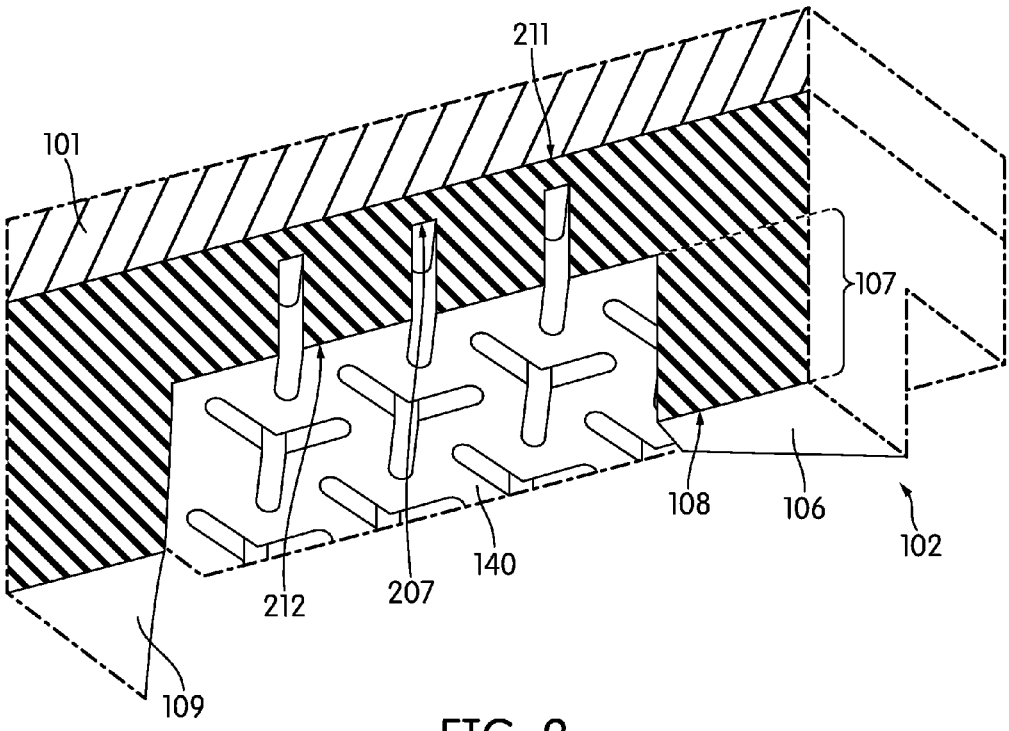
FIG. 2 is a cut away view of an embodiment of the article of footwear shown in FIG. 1.

In some instances it is desirable to include non-clogging functionality for surfaces spaced from the ground-contacting surface in order to prevent debris from interfering with the ground-contacting surface. Accordingly, in certain embodiments, the sole includes an auxetic structure integrally formed into a base surface. For example, as shown in FIG. 2, an auxetic structure is integrally formed into base surface 212. As discussed further below, the auxetic structure may have various characteristics to expel debris adhered on the sole.

The sole 102 may be constrained by an attachment to the upper. As used herein, a surface is constrained when a shape of the surface conforms to a shape of another surface. For example, the sole 102 may be constrained to conform to a shape of the upper 101. Similarly, the recessed surface may be constrained by the shape of the upper. For example, the recessed surface 207 of the sole 102 may be constrained to conform to a shape of the upper 101. In another example, the upper surface 211 of the sole 102 may be constrained to conform to a shape of the upper 101.

In some embodiments, sole 102 may include at least one protrusion that may be the primary ground-contacting surface (e.g., ground-engaging surface). For example, the protrusion may be configured to contact grass, synthetic turf, dirt, or sand. As shown, for example, in FIGS. 1 and 2, the sole 102 may include protrusion 106. The protrusion may include provisions for increasing traction with a playing surface. Similarly, in various embodiments, a base surface of the sole may be spaced from the ground-contacting surface (e.g., ground-engaging surface). For example, as shown in FIGS. 1 and 2, the base surface 212 of sole 102 may be spaced from the protrusion 106 in the vertical direction.

The protrusion may have a ground contacting surface of various shapes and/or sizes. In some embodiments, the ground contacting surface forms the ground-engaging surface of the sole 102. For example, as shown in FIG. 2, the protrusion 106 has ground contacting surface 108 that forms the ground-engaging surface. Similarly, the protrusion may have various heights in different embodiments. For example, as shown in FIG. 2, the protrusion 106 has a separation distance 107 that spaces the ground-engaging surface from the base surface 212. The separation distance may extend between a base surface of the sole and the ground contacting surface of the sole. For example, separation distance 107 extends between base surface 212 of sole 102 and ground contacting surface 108. In some embodiments, the base surface is spaced closer to the recessed surface than to the ground contacting surface. For example, as shown in FIG. 2, the base surface 212 is spaced closer to the recessed surface 207 than to the ground contacting surface 108. In other embodiments, the base surface is spaced equidistant to the recessed surface and to the ground contacting surface (not shown).

In the various embodiments, the sole may include any number of protrusions that may have one or more features of protrusion 106. For example, as shown in FIGS. 1 and 2, protrusion 109 may be substantially similar to protrusion 106. In other embodiments, the protrusion 106 may be different from other protrusions of the sole (not shown).

The protrusions may be arranged in any protrusion pattern on the sole. For example, in the exemplary embodiment shown in FIG. 2, the sole 102 has rectangular shaped protrusions positioned along medial and lateral sides of the article. In other embodiments, the sole may have protrusions centered between the medial and lateral sides of the article (not shown). In some embodiments, the protrusions form a particular pattern throughout the exposed surface of the sole 102 (not shown). While embodiments of FIGS. 1-15 are illustrated with the same protrusion pattern (arrangement), it is understood that other protrusion patterns may be used.

The arrangement of the protrusions may enhance traction for a wearer during cutting, turning, stopping, accelerating, and backward movement.

In some embodiments, the various protrusions may have similar or even identical shapes. For example, protrusion 106 and protrusion 109 may have a rectangular shape. In other embodiments, at least one of the protrusions may have a different shape from another protrusion. In some embodiments, the protrusions may have a first set of identically shaped protrusions and/or a second set of identically shaped protrusions.

In some embodiments, the protrusions may have the same height, width, and/or thickness as each other. For example, protrusion 106 and protrusion 109 may have a separation distance 107 that spaces ground contacting surface 108 from the base surface 212. In other embodiments, the protrusions may have different heights, different widths, and/or different thicknesses from each other. In some embodiments, a first set of protrusions may have the same height, width, and/or thickness as each other, while a second set of protrusions may have a different height, width, and/or thickness from the first set of protrusions.

An auxetic structure may be integrally formed into the base surface by forming voids of various depths. In some embodiments, the recessed surface is spaced closer to the upper surface than the base surface. For example, as shown in FIG. 2, the recessed surface 207 is spaced closer to the upper surface 211 than the base surface 212. Similarly, in certain embodiments, the recessed surface is spaced closer to the upper surface than the ground contacting surface. For example, as shown in FIG. 2, the recessed surface 207 is spaced closer to the upper surface 211 than a ground contacting surface 108 of a protrusion 106. In other embodiments, the recessed surface is spaced closer to the ground contacting surface than the upper surface (not shown).

The auxetic structure 140 may be constrained by the various protrusions of the sole 102. In some embodiments, the auxetic structure is constrained between the first ground contacting element and the second ground contacting element. For example, the auxetic structure 140 is constrained between protrusion 106 and protrusion 109, thereby preventing the auxetic structure 140 from extending beyond the protrusion 106 and a protrusion 109.

In some embodiments, the auxetic structure is constrained between the first ground contacting element and the second ground contacting element such that the auxetic structure is configured to move in multiple directions. For example, the auxetic structure 140 is constrained between protrusion 106 and protrusion 109 such that the auxetic structure 140 is configured to move in a first direction and a second direction. In the example, the first direction is normal to the bottom surface and the second direction is perpendicular to the first direction.

In other embodiments, the auxetic structure is constrained between a first ground contacting element and the second ground contacting element such that the auxetic structure is configured to move in a single direction. For example, the auxetic structure 140 is constrained between protrusion 106 and protrusion 109 such that the auxetic structure 140 is configured to move in the first direction.

Figure 3:
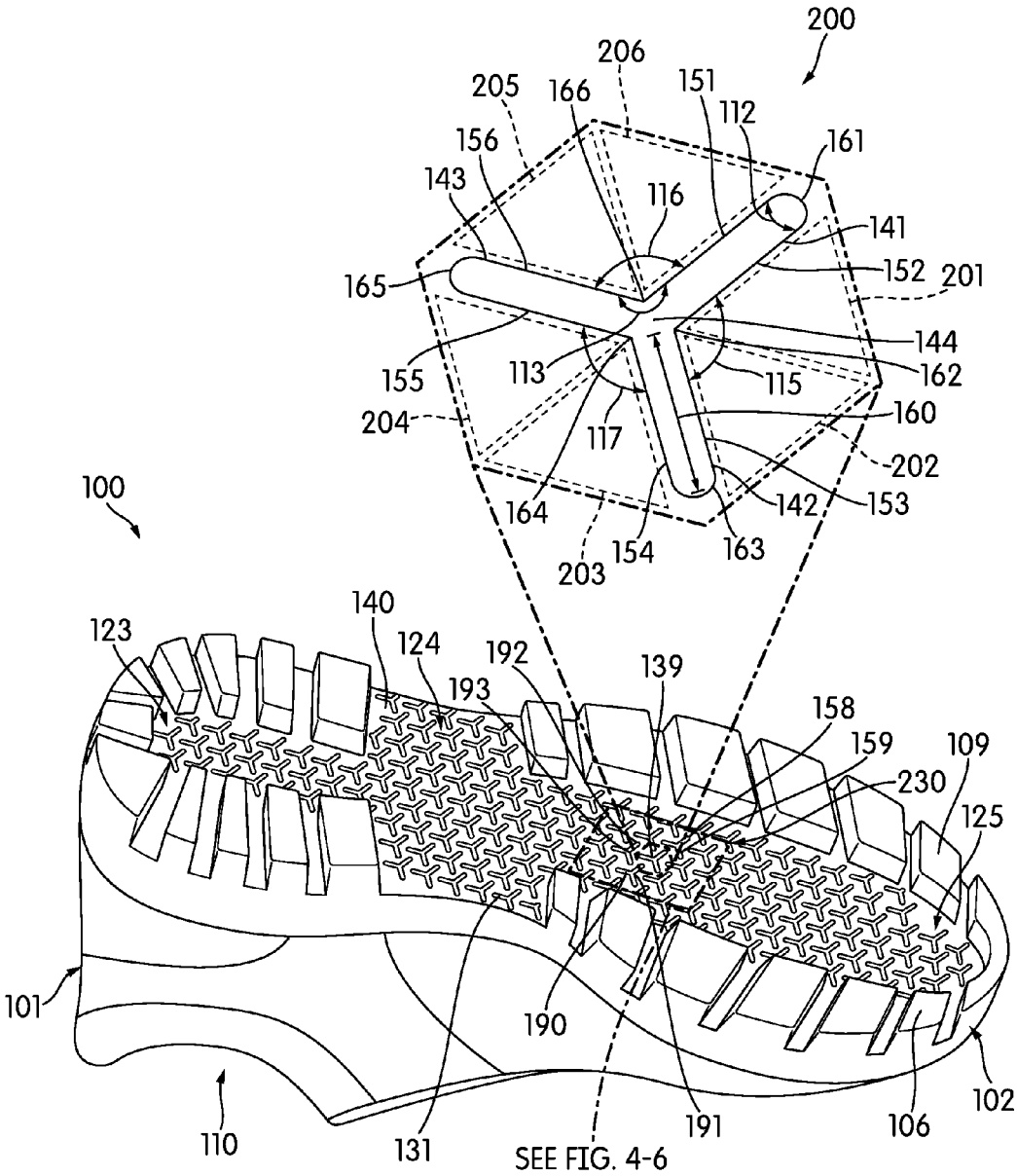
FIG. 3 is a schematic diagram of a bottom perspective view of an embodiment of the article of footwear shown in FIG. 1.

FIG. 3 is a bottom perspective view of an embodiment of an article of footwear. This figure shows the auxetic structure 140. Auxetic structure 140 may have a heel region 123, an instep or midfoot region 124, and a forefoot region 125 as shown in FIG. 3.

The auxetic structure may be various shapes and sizes. As used herein, an auxetic structure may have a negative Poisson's ratio. In some embodiments, the auxetic structure may have a particular shape that results in a negative Poisson's ratio. For example, as shown in FIG. 3, the auxetic structure 140 may have a tristar-shaped pattern. In another example, the auxetic structure is an auxetic hexagon that stretches toward a square-shaped pattern. In other embodiments, the auxetic structure is formed of a material having an auxetic characteristic. For example, the auxetic structure 140 may be formed using foam structures having a negative Poisson's ratio. In some embodiments, the auxetic structure 140 may form more than seventy percent of the exposed surface of the sole 102. In other embodiments, the auxetic structure forms less than seventy percent of the sole 102. For example, the auxetic structure 140 may extend in a midfoot region 124 and the auxetic structure may be omitted from the heel region 123 and forefoot region 125 (not shown).

In the exemplary embodiment, auxetic structure 140 has a tristar-shaped pattern having radial segments that are joined to each other at their center. The radial segments at the center may function as hinges, allowing the radial segments to rotate as the sole is placed under tension. This action may allow the portion of the sole under tension to expand both in the direction under tension and in the direction in the plane of the sole that is orthogonal to the direction under tension. Thus, the tristar-shaped pattern may form an auxetic structure 140 for sole 102 for facilitating a non-clogging functionality of the sole 102, which is described in further detail below. As previously noted, in other embodiments, other shapes and/or patterns that result in a negative Poisson's ratio may be used. In certain embodiments, the auxetic structure is formed using a material having an auxetic characteristic.

As shown in FIG. 3, auxetic structure 140 includes a plurality of tristar-shaped voids 131, also referred to simply as voids 131 hereafter. As an example, an enlarged view void 139 of plurality of voids 131 is shown schematically within FIG. 3. In some embodiments, voids may extend between the base surface and the recessed surface. For example, voids 131 may extend between the base surface 212 and the recessed surface 207. In other embodiments, the voids may extend between the base surface and the upper (not shown). Void 139 is further depicted as having a first radial segment 141, a second radial segment 142, and a third radial segment 143. Each of these portions is joined together at a center 144. Similarly, in some embodiments, each of the remaining voids in voids 131 may include three radial segments that are joined together, and extend outwardly from, a center.

In some embodiments, the radial segments are substantially equal in length. As used herein, lengths may be substantially equal when a difference between lengths is less than 10 percent. For example, as shown in FIG. 3, the first radial segment 141, a second radial segment 142, and a third radial segment 143 are substantially equal in length. Similarly, in some embodiments, two of the radial segments are substantially equal in length and one of the radial segments is different (not shown). Moreover, in various embodiments, the length of a radial segment may be less than a separation distance 107 between the ground contacting surface and the base surface. For example, as shown in FIGS. 2 and 3, the length 160 of the second radial segment 142 is less than ½ of a separation distance 107 between the ground contacting surface 108 and the base surface 212. In other embodiments, the length is between 1/50 and ½ of the separation distance. For example, as shown, the length 160 is between 1/50 and ½ of the separation distance 107.

Generally, each void in plurality of voids 131 may have any kind of geometry. In some embodiments, a void may have a polygonal geometry, including a convex and/or concave polygonal geometry. In such cases, a void may be characterized as comprising a particular number of vertices and edges (or sides). In an exemplary embodiment, voids 131 may be characterized as having six sides and six vertices. For example, void 139 is shown as having first side 151, second side 152, third side 153, fourth side 154, fifth side 155 and sixth side 156. Additionally, void 139 is shown as having a first vertex 161, second vertex 162, third vertex 163, fourth vertex 164, fifth vertex 165 and sixth vertex 166. It may be appreciated that in the exemplary embodiment, the some of the vertices (e.g., first vertex 161, third vertex 163 and fifth vertex 165) may not be arc-like vertices. Instead, the edges joining at these vertices may be straight at these vertices to provide a more pointed vertex geometry. In contrast, in the exemplary embodiment, some vertices may have arc-like geometries, including second vertex 162, fourth vertex 164 and sixth vertex 166.

In one embodiment, the shape of void 139 (and correspondingly of one or more of voids 131) could be characterized as a regular polygon (not shown), which is both cyclic and equilateral. In some embodiments, the geometry of void 139 can be characterized as triangles with sides that, instead of being straight, have an inwardly-pointing vertex at the midpoint of the side (not shown). The reentrant angle formed at these inwardly-pointing vertices can range from 180° (when the side is perfectly straight) to, for example, 120° or less.

The shape of void 139 may be formed of other geometries, including a variety of polygonal and/or curved geometries. Exemplary polygonal shapes that may be used with one or more of voids 131 include, but are not limited to: regular polygonal shapes (e.g., triangular, rectangular, pentagonal, hexagonal, etc.) as well as irregular polygonal shapes or non-polygonal shapes. Other geometries could be described as being quadrilateral, pentagonal, hexagonal, heptagonal, octagonal or other polygonal shapes with reentrant sides. In still other embodiments, the geometry of one or more voids need not be polygonal, and instead voids could have any curved and/or non-linear geometries, including sides or edges with curved or non-linear shapes.

In the exemplary embodiment, the vertices of a void (e.g., void 139) may correspond to interior angles that are less than 180 degrees or interior angles that are greater than 180 degrees. For example, with respect to void 139, first vertex 161, third vertex 163 and fifth vertex 165 may correspond to interior angles that are less than 180 degrees. In this particular example, each of first vertex 161, third vertex 163 and fifth vertex 165 has an interior angle A1 that is less than 180 degrees. In other words, void 139 may have a locally convex geometry at each of these vertices (relative to the outer side of void 139). In contrast, second vertex 162, fourth vertex 164 and sixth vertex 166 may correspond to interior angles that are greater than 180 degrees. In other words, void 139 may have a locally concave geometry at each of these vertices (relative to the outer side of void 139).

In various embodiments, the depicted voids have central angles that are substantially equal. As used herein, angles are substantially equal when within 10 degrees of each other, within 5 degrees of each other, within 2 degrees of each other, etc. In some embodiments, the first central angle and the second central angle are substantially equal. For example, as shown in FIG. 3, the first central angle 115 and the second central angle 116 are substantially equal. Similarly, in various embodiments, the first central angle and the third central angle are substantially equal. For example, as shown in FIG. 3, the first central angle 115 and the third central angle 117 are substantially equal.

Although the embodiments depict voids having approximately polygonal geometries, including approximately arc-like vertices at which adjoining sides or edges connect, in other embodiments some or all of a void could be non-polygonal. In particular, in some cases, the outer edges or sides of some or all of a void may not be joined at vertices, but may be continuously curved. Moreover, some embodiments can include voids having a geometry that includes both straight edges connected via vertices as well as curved or non-linear edges without any points or vertices.

In some embodiments, voids 131 may be arranged in a regular pattern on auxetic structure 140. In some embodiments, voids 131 may be arranged such that each vertex of a void is disposed near the vertex of another void (e.g., an adjacent or nearby void). More specifically, in some cases, voids 131 may be arranged such that every vertex that has an interior angle less than 180 degrees is disposed near a vertex that has an interior angle greater than 180 degrees. As one example, fourth vertex 164 of void 139 is disposed near, or adjacent to, a vertex 191 of another void 190. Here, vertex 191 is seen to have an interior angle that is less than 180 degrees, while fourth vertex 164 has an interior angle that is greater than 180 degrees. Similarly, fifth vertex 165 of void 139 is disposed near, or adjacent to, a vertex 193 of another void 192. Here, vertex 193 is seen to have an interior angle that is greater than 180 degrees, while fifth vertex 165 has an interior angle that is greater than 180 degrees.

In various embodiments, the radial segments of one void may be substantially aligned with a radial segment of another one of the voids. As used herein, radial segments may be substantially aligned when a difference in angle between the radial segments is less than 5 degrees. For example, as shown in FIG. 3, the first radial segment 141 of void 139 may be substantially aligned with a radial segment 158 of void 159 of the voids 131.

The configuration resulting from the above arrangement may be seen to divide auxetic structure 140 into smaller geometric portions, whose boundaries are defined by the edges of voids 131. In some embodiments, these geometric portions may be formed of sole portions which are polygonal in shape. For example, in the exemplary embodiment, voids 131 are arranged in a manner that defines a plurality of sole portions 200, also referred to hereafter simply as sole portions 200. In other embodiments, the sole portions have other shapes.

Generally, the geometry of sole portions 200 may be defined by the geometry of voids 131 as well as their arrangement on auxetic structure 140. In the exemplary configuration, voids 131 are shaped and arranged to define a plurality of approximately triangular portions, with boundaries defined by edges of adjacent voids. Of course, in other embodiments polygonal portions could have any other shape, including rectangular, pentagonal, hexagonal, as well as possibly other kinds of regular and irregular polygonal shapes. Furthermore, it will be understood that in other embodiments, voids may be arranged on a sole to define geometric portions that are not necessarily polygonal (e.g., comprised of approximately straight edges joined at vertices). The shapes of geometric portions in other embodiments could vary and could include various rounded, curved, contoured, wavy, nonlinear as well as any other kinds of shapes or shape characteristics.

As seen in FIG. 3, sole portions 200 may be arranged in regular geometric patterns around each void. For example, void 139 is seen to be associated with first polygonal portion 201, second polygonal portion 202, third polygonal portion 203, fourth polygonal portion 204, fifth polygonal portion 205 and sixth polygonal portion 206. Moreover, the approximately even arrangement of these polygonal portions around void 139 forms an approximately hexagonal shape that surrounds void 139.

In some embodiments, the various vertices of a void may function as a hinge. In particular, in some embodiments, adjacent portions of material, including one or more geometric portions (e.g., polygonal portions), may rotate about a hinge portion associated with a vertex of the void. As one example, each vertex of void 139 is associated with a corresponding hinge portion, which joins adjacent polygonal portions in a rotatable manner.

In the exemplary embodiment, void 139 includes hinge portion 210 (see FIGS. 4-6), which is associated with first vertex 161. Hinge portion 210 is comprised of a relatively small portion of material adjoining first polygonal portion 201 and sixth polygonal portion 206. As discussed in further detail below, first polygonal portion 201 and sixth polygonal portion 206 may rotate (or pivot) with respect to one another at hinge portion 210. In a similar manner, each of the remaining vertices of void 139 is associated with similar hinge portions that join adjacent polygonal portions in a rotatable manner.

Figure 4:
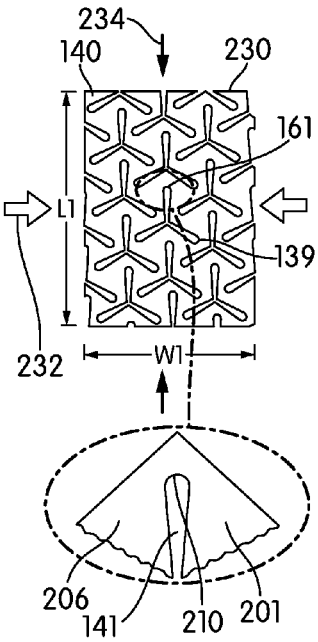
FIG. 4 shows a schematic diagram of a bottom view of the portion of the sole of FIG. 3 in a compression configuration, in accordance with exemplary embodiments.
Figure 5:
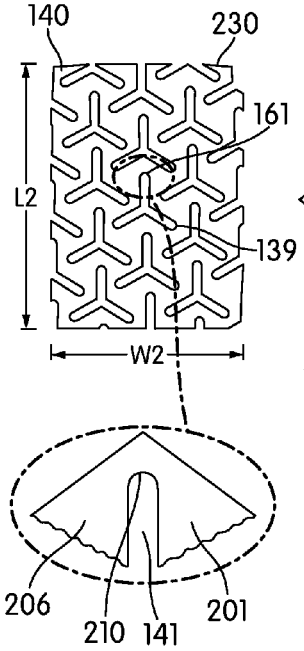
FIG. 5 shows a schematic diagram of a bottom view of the portion of the sole of FIG. 3 in a relaxed configuration, in accordance with exemplary embodiments.
Figure 6:
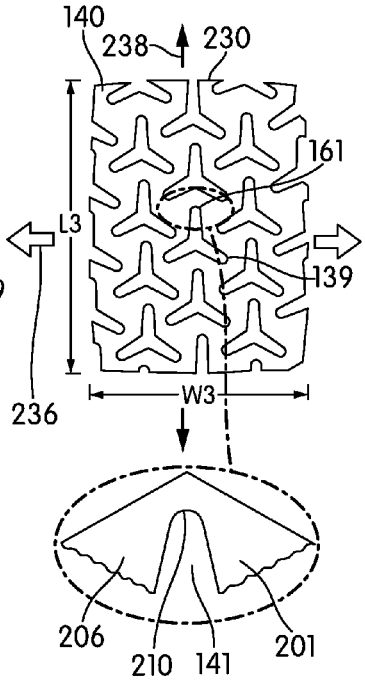
FIG. 6 shows a schematic diagram of a bottom view of the portion of the sole of FIG. 3 in an expansion configuration, in accordance with exemplary embodiments.

FIGS. 4-6 illustrate a schematic sequence of configurations for a portion of auxetic structure 140 under a tensioning force applied along a single axis or direction. Specifically, FIGS. 4-6 are intended to illustrate how the geometric arrangements of voids 131 and sole portions 200 provide auxetic properties to auxetic structure 140, thereby allowing portions of auxetic structure 140 to expand in both the direction of applied tension and a direction perpendicular to the direction of applied tension.

As shown in FIGS. 4-6, an exposed surface 230 of auxetic structure 140 proceeds through various configurations as a result of an applied tension in a linear direction (for example, the longitudinal direction). In particular, the configuration of FIG. 4 may be associated with a compression force 232 applied along a first direction and associated with a compression 234 along a second direction that is orthogonal to the first direction of compression force 232. Additionally, the configurations of FIG. 5 may be associated with a relaxed state. Finally, the configuration of FIG. 6 may be associated with a tensioning force 236 applied along a first direction and associated with an expansion 238 along a second direction that is orthogonal to the first direction of tensioning force 236. It should be understood that the configurations are of an outer surface of an auxetic structure and the configurations of the recessed surface may remain constant. For example, as shown in FIG. 2, the recessed surface may be attached to the lower surface. In another example, the recessed surface may be constrained by the lower surface.

Due to the specific geometric configuration for sole portions 200 and their attachment via hinge portions, the compression and expansion is transformed into rotation of adjacent sole portions 200. For example, first polygonal portion 201 and sixth polygonal portion 206 are rotated at hinge portion 210. All of the remaining sole portions 200 are likewise rotated as voids 131 compress or expand. Thus, the relative spacing between adjacent sole portions 200 changes according to the compression or expansion. For example, as seen clearly in FIG. 4, the relative spacing between first polygonal portion 201 and sixth polygonal portion 206 (and thus the size of first radial segment 141 of void 139) decreases with increased compression. In another example, as seen clearly in FIG. 6, the relative spacing between first polygonal portion 201 and sixth polygonal portion 206 (and thus the size of first radial segment 141 of void 139) increases with increased expansion.

As the increase in relative spacing occurs in all directions (due to the symmetry of the original geometric pattern of voids), this results the expansion of exposed surface 230 along a first direction as well as along a second direction orthogonal to the first direction. For example, in the exemplary embodiment of FIG. 4, in the compression configuration, exposed surface 230 initially has an initial size W1 along a first linear direction (e.g., the longitudinal direction) and an initial size L1 along a second linear direction that is orthogonal to the first direction (e.g., the lateral direction). In another example, in the exemplary embodiment of FIG. 5, in the relaxed configuration, exposed surface 230 has a size W2 along a first linear direction (e.g., the longitudinal direction) and a size L2 along a second linear direction that is orthogonal to the first direction (e.g., the lateral direction). In the expansion configuration of FIG. 6, exposed surface 230 has an increased size W3 in the first direction and an increased size L3 in the second direction. Thus, it is clear that the expansion of exposed surface 230 is not limited to expansion in the tensioning direction.

In some embodiments, the amount of compression and/or expansion (e.g., the ratio of the final size to the initial size) may be approximately similar between the first direction and the second direction. In other words, in some cases, exposed surface 230 may expand or contract by the same relative amount in, for example, both the longitudinal direction and the lateral direction. In contrast, some other kinds of structures and/or materials may contract in directions orthogonal to the direction of applied expansion. It should be understood that an recessed surface of the auxetic structure position on the opposite side from the exposed surface 230 may be constrained due to, for example, an attachment to the upper. For example, the recessed surface 207 may be constrained due to an attachment of the upper surface 211 to upper 101 that bonds a substantial portion of the upper surface 211 to upper 101 (see FIG. 2).

In the exemplary embodiments shown in the figures, an auxetic structure may be tensioned in the longitudinal direction or the lateral direction. However, the arrangement discussed here for auxetic structures comprised of voids surrounded by geometric portions provides a structure that can expand or contract along any first direction along which tension is applied, as well as along a second direction that is orthogonal to the first direction. Moreover, it should be understood that the directions of expansion, namely the first direction and the second direction, may generally be tangential to a surface of the auxetic structure. In particular, the auxetic structures discussed here may generally not expand in a vertical direction that is associated with a thickness of the auxetic structure.

Figure 7:
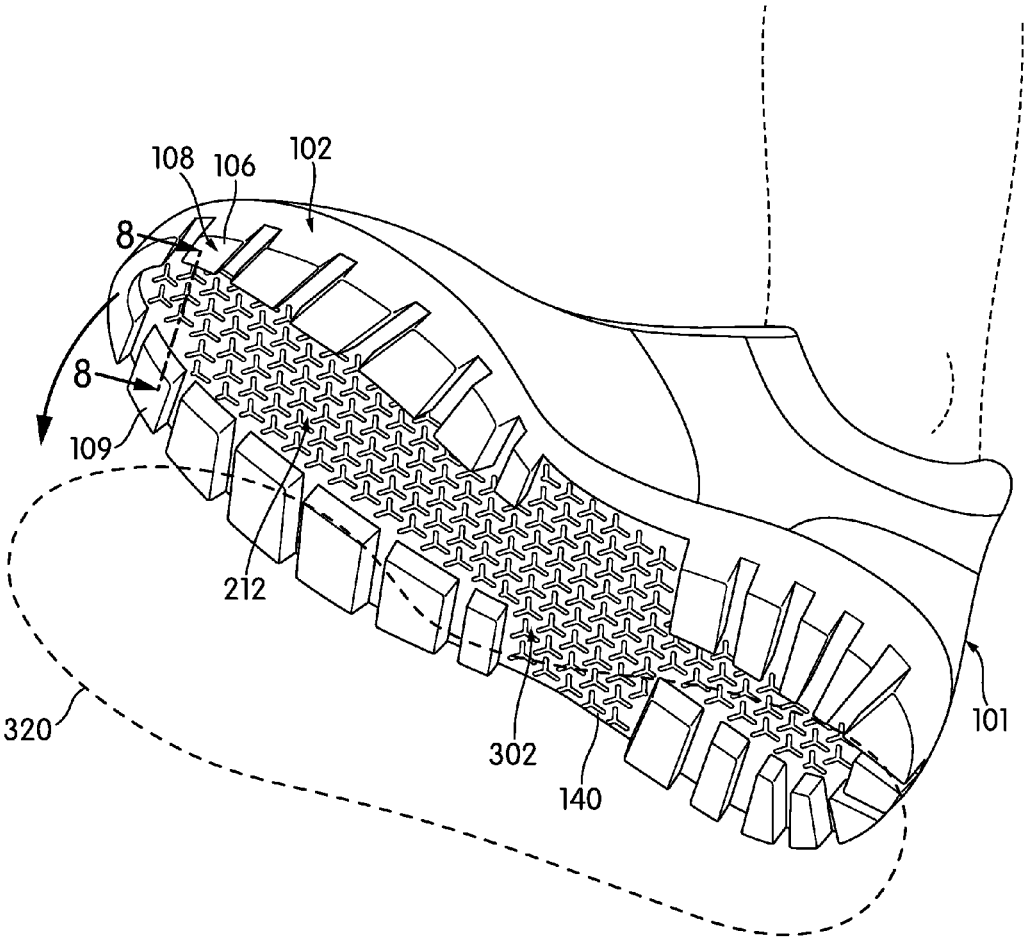
FIG. 7 is a schematic diagram of a sole structure prior to impact with a playing surface, in accordance with exemplary embodiments.
Figure 8:
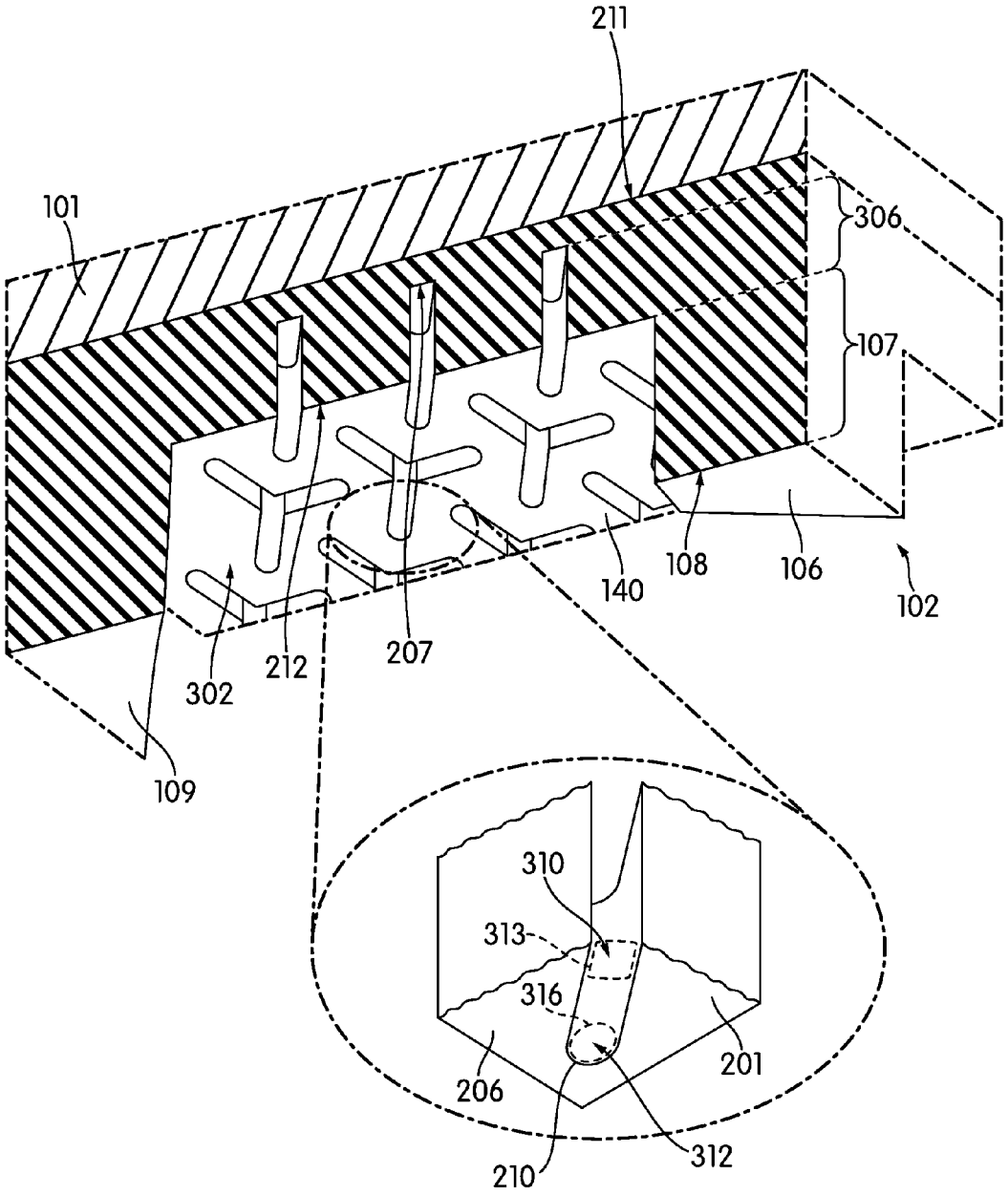
FIG. 8 is a cut away view of the sole structure of FIG. 7, in accordance with exemplary embodiments.
Figure 9:
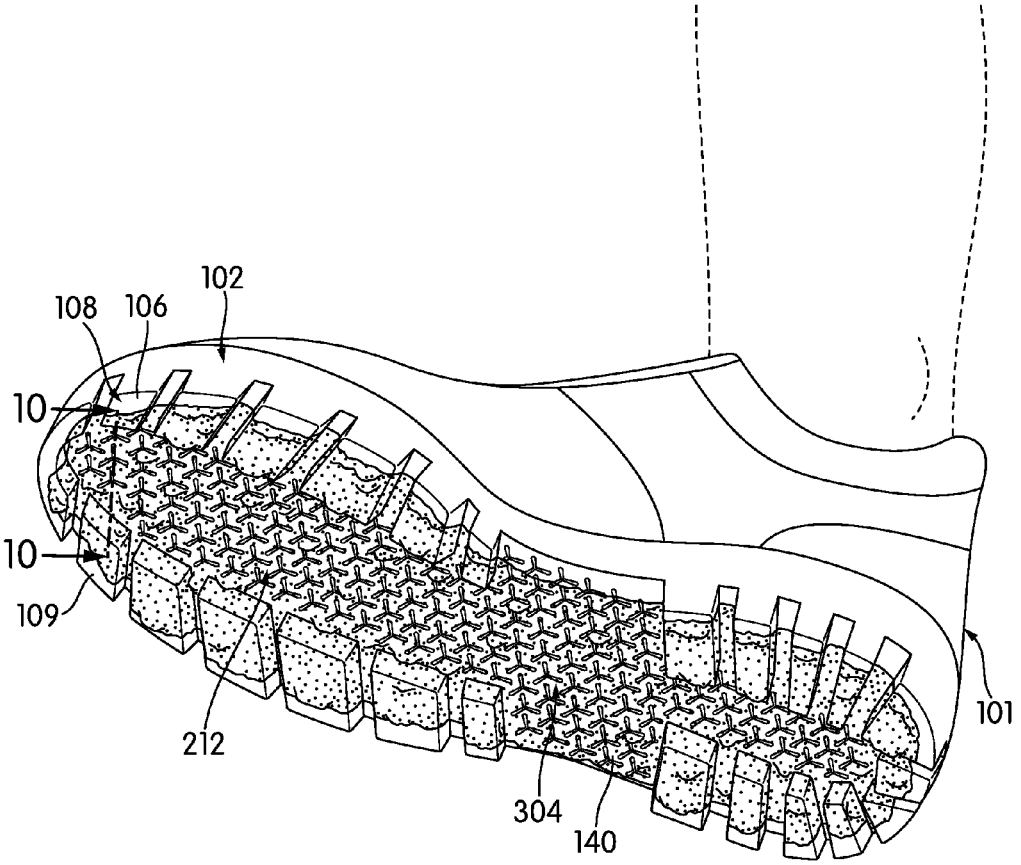
FIG. 9 is a schematic diagram of a sole structure during an impact with a playing surface, in accordance with exemplary embodiments.
Figure 10:
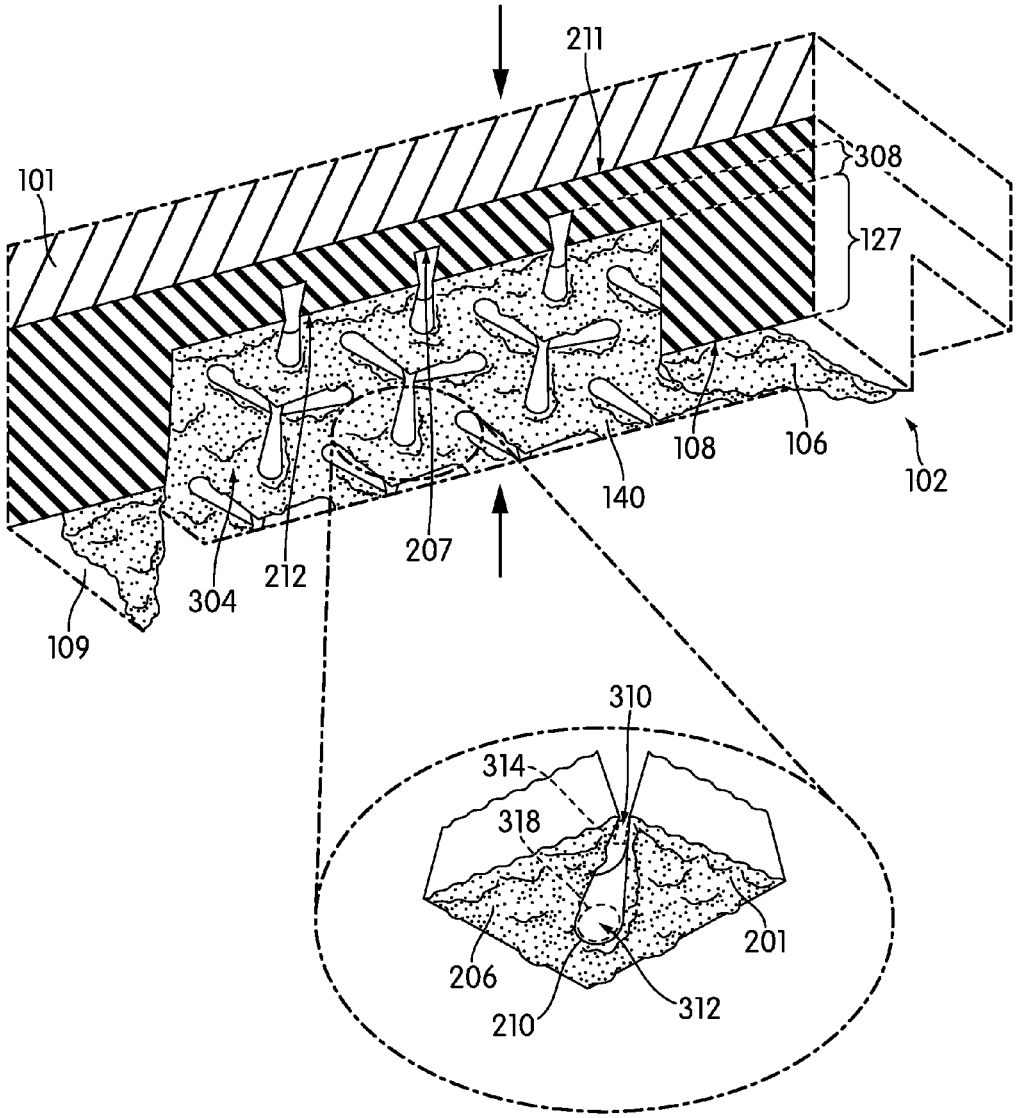
FIG. 10 is a cut away view of the sole structure of FIG. 9, in accordance with exemplary embodiments.

In certain embodiments, the base surface of the auxetic structure changes a surface area in response to a compressive force. For example, as shown in FIGS. 7 and 8, the base surface 212 has a first surface area 302 when not exposed to a compressive force. In the example, as shown in FIGS. 9 and 10, the base surface 212 has a second surface area 304 when exposed to the compressive force. In an exemplary embodiment, the second surface area 304 may be greater than the first surface area 302. In other words, the surface area of base surface 212 may expand under compression. In some embodiments, the second surface area is at least five percent more than the first surface area. For example, as shown, the second surface area 304 is at least five percent more than the first surface area 302. In other examples, the second surface area is more than the first surface area by at least 10 percent, at least 15 percent, at least 20 percent etc. In some embodiments, the compressive force is associated with an impact of an article on a playing surface. For example, the compressive force may be more than 1,000 Newtons.

In some embodiments, a compressive force modifies a separation distance between the recessed surface and the base surface. For example, as shown in FIGS. 8 and 10, a compressive force with a playing surface 320 modifies a separation distance between the recessed surface 207 and the base surface 212 from non-compressed separation distance 306 to compressed separation distance 308. In certain embodiments, the compressive force reduces the separation distance such that the compressed separation distance 308 is less than non-compressed separation distance 306 by at least thirty percent, at least twenty percent, at least ten percent, at least five percent, etc. In various embodiments, the compressive force is in a direction associated with a thickness of the auxetic structure.

In some embodiments, a compressive force modifies a separation distance between the ground contacting surface of the protrusion and the base surface. For example, as shown in FIGS. 8 and 10, a compressive force with a playing surface 320 modifies a separation distance between the ground contacting surface 108 of the protrusion 106 and the base surface 212 from compressed separation distance 107 to compressed separation distance 127. In certain embodiments, the compressive force reduces the separation distance such that the compressed separation distance 127 is less than compressed separation distance 107 by at least thirty percent, at least twenty percent, at least ten percent, at least five percent, etc. In various embodiments, the compressive force is in a direction associated with a thickness of the protrusion.

The separation distance between the recessed surface and the base surface may be less than the separation distance between the ground contacting surface of the protrusion and the base surface. In some embodiments, the non-compressed separation distance is less than the height of the protrusion. For example, as shown in FIG. 8, non-compressed separation distance 306 is less than the separation distance 107 between the ground contacting surface 108 of the protrusion 106 and the base surface 212. In another example, non-compressed separation distance 306 is less than the compressed separation distance 127 between the ground contacting surface 108 of the protrusion 106 and the base surface 212. In certain embodiments, the non-compressed separation distance is less than half the height, less than ¾ the height, etc. For example, the non-compressed separation distance 306 is less than half the separation distance 107 and less than ¾ the separation distance 107. Similarly, in various embodiments, the compressed separation distance is less than the separation distance of the protrusion. For example, as shown in FIG. 10, compressed separation distance 308 is less than the separation distance 107 of the protrusion 106. In another example, as shown in FIG. 10, compressed separation distance 308 is less than the compressed separation distance 127 of the protrusion 106. In certain embodiments, the compressed separation distance is less than half the separation distance, less than ¾ the separation distance, etc. For example, the compressed separation distance 308 is less than half the separation distance 107 and less than ¾ the separation distance 107.

In certain embodiments, surface areas of portions of voids change differently in response to the compressive force. For example, as discussed with respect to FIGS. 4-6, polygonal portion 201 and sixth polygonal portion 206 are rotated at hinge portion 210. In FIGS. 8 and 10, reference is made to a first void portion 310 and a second void portion 312 of first radial segment 141 of void 139. As seen in FIG. 8, first void portion 310 may be disposed closer to a center of void 139, while second void portion 312 may be disposed proximate to hinge portion 210. Moreover, first void portion 310 may be associated with a non-compressed area 313, which may generally have a polygonal shape. Also, second void portion 312 may be associated with a non-compressed area 316, which may generally have a rounded shape.

Accordingly, in various embodiments, a compressive force may decrease a surface area of a first void portion 310 more than a second void portion 312. For example, as shown in FIGS. 8 and 10, a compressive force may decrease the first void portion 310 from a non-compressed area 313 to a compressed area 314. In another example, as shown in FIGS. 8 and 10, a compressive force may decrease the second void portion 312 from a non-compressed area 316 to a compressed area 318. As clearly shown, the area of first void portion 310 is decreased much more than the area of second void portion 312. In some cases, for example, the associated decrease in the area of first void portion 310 could be ten percent greater than the associated decrease in the area of second void portion 312.

Figure 11:
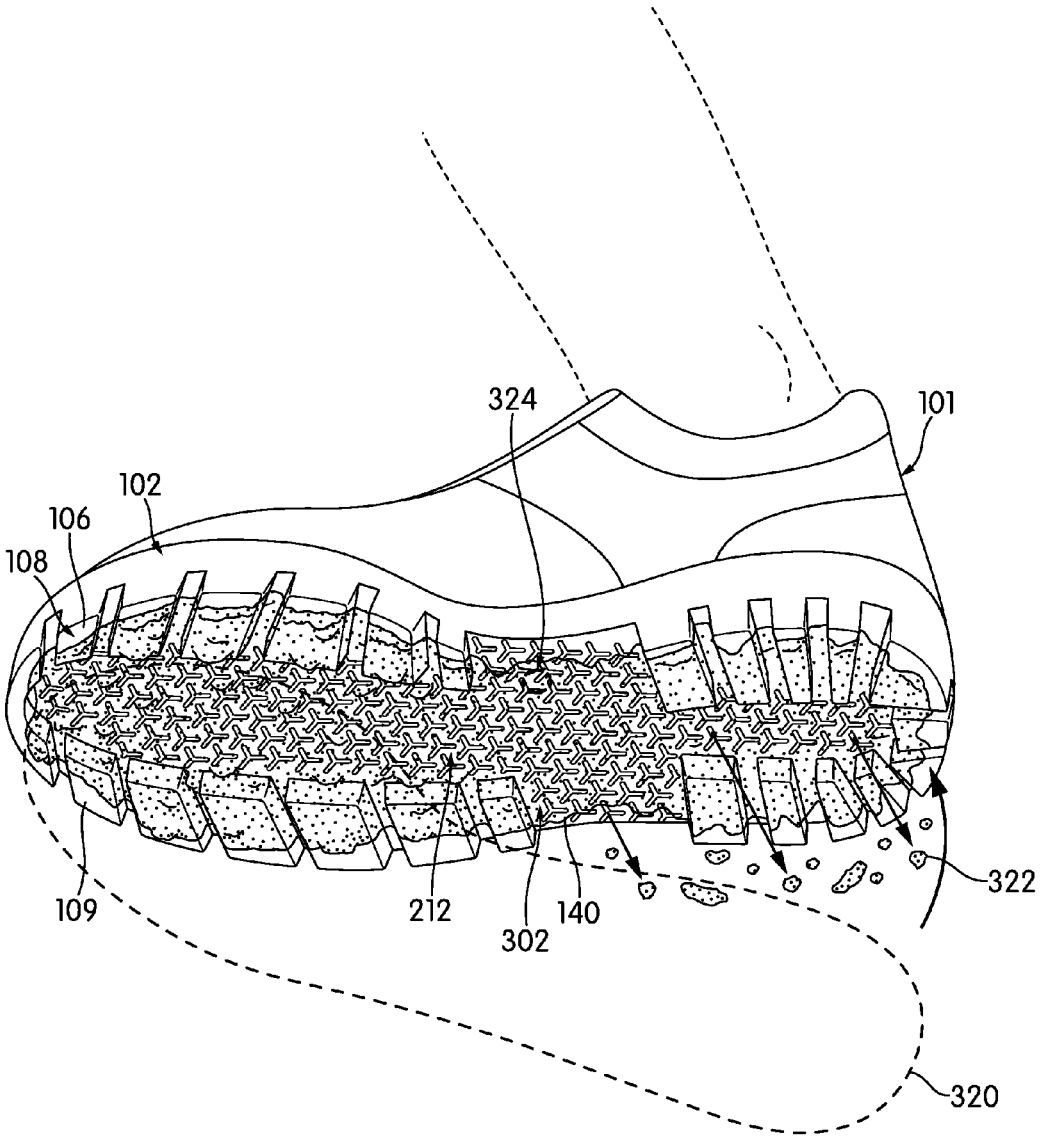
FIG. 11 is a schematic diagram of a sole structure after impact with a playing surface, in accordance with exemplary embodiments.

In some embodiments, the difference in changes to portions of the voids facilitates a declogging function of the sole. For example, as illustrated in FIG. 11, the auxetic structure 140 may help to remove debris 322 from the sole 102.

Accordingly, in some embodiments, the addition of the auxetic structure, as described in the various embodiments, may improve a non-clogging property of a resulting article. In some embodiments, an adherence of debris onto the base surface may be at least fifteen percent less than an adherence of debris onto a control sole. For example, an adherence of debris 322 onto the base surface 212 may be at least fifteen percent less than an adherence of debris onto a control sole. In some embodiments, the control sole may be identical to the sole structure except that the control sole does not include the auxetic structure. For example, the control sole may be identical to the sole 102 except that the control sole does not include the auxetic structure 140.

Moreover, in various embodiments, the addition of the auxetic structure, as described in the various embodiments, may improve a non-clogging performance of a resulting article. In some embodiments, following a 30 minute wear test on a wet grass field, a weight of debris adsorbed to the base surface may be at least fifteen percent less than a weight of debris adsorbed to a control sole. For example, following a 30 minute wear test on a wet grass field, a weight of debris adsorbed to the base surface 212 may be at least fifteen percent less than a weight of debris adsorbed to a control sole. In various embodiments, the control sole may be identical to the sole structure except that the control sole does not include the auxetic structure (not shown).

Figure 12:
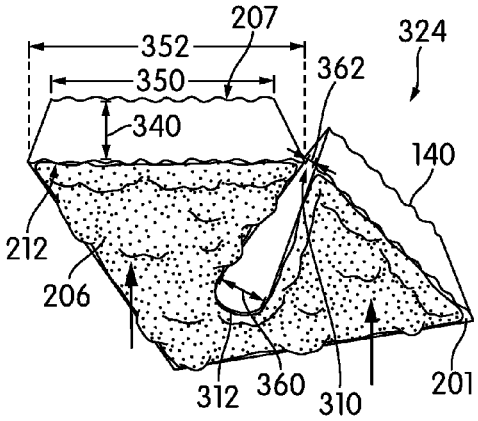
FIG. 12 is an enlarged view of the sole structure of FIG. 11 while in a compressed state, in accordance with exemplary embodiments.
Figure 13:
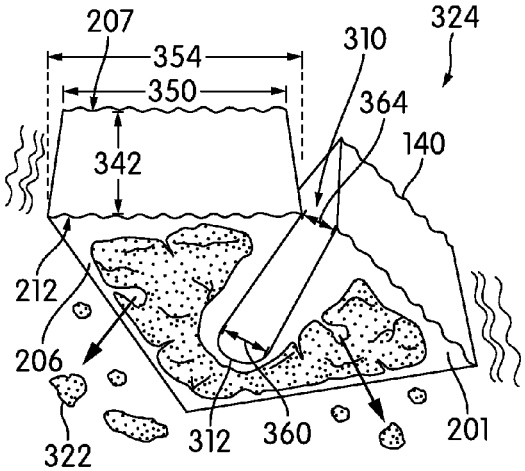
FIG. 13 is an enlarged view of the sole structure of FIG. 11 during a first stage of uncompressing, in accordance with exemplary embodiments.
Figure 14:
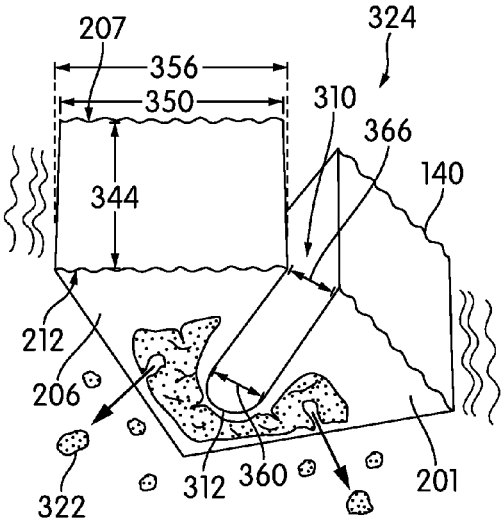
FIG. 14 is an enlarged view of the sole structure of FIG. 11 during a second stage of uncompressing, in accordance with exemplary embodiments.
Figure 15:
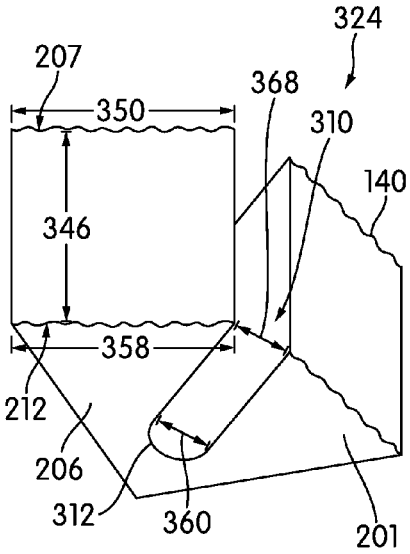
FIG. 15 is an enlarged view of the sole structure of FIG. 11 while in an uncompressed state, in accordance with exemplary embodiments.

In various embodiments, such a removal of debris is a result of sheer force on the outer surface when exposed to a compressive force. For example, as shown in FIGS. 12-15, decompression of the auxetic structure 140 may cause a sheer force that helps to remove debris from the article 100. As shown in FIG. 12, a compressive force may result in the auxetic structure 140 having a height 340. In the example, the height 340 may be between the base surface 212 and the recessed surface 207. As shown in FIG. 13, the auxetic structure 140 expands outward as it decompresses resulting in height 342. Next, as shown in FIG. 14, the auxetic structure 140 expands outward as it decompresses resulting in height 344. Finally, as shown in FIG. 15, the auxetic structure 140 has a height 346 when in an uncompressed state that is greater than the height 344. As discussed further, the auxetic structure 140 changing from height 340 to height 346 may result in sheer forces on the base surface 212 that help to remove debris 322.

The sheer force may result from changing surface areas of the auxetic structure during a decompression of the auxetic structure. In some embodiments, such a change in surface area may be due to a change in relative lengths between the recessed surface of the auxetic structure and the outer surface of the auxetic structure. For example, as shown in FIG. 12, the recessed surface 207 of the portion 324 has a length 350 that is smaller than the length 352 of the base surface 212. As shown in FIG. 13, the base surface 212 of the portion 324 reduces from length 352 to length 354 during a first stage of uncompressing. Next, as shown in FIG. 14, the base surface 212 of the portion 324 reduces from length 354 to length 356 during a second stage of uncompressing. Finally, as shown in FIG. 15, the base surface 212 of the portion 324 has a length 358 that is less than length 356 while in an uncompressed state. In some embodiments, such a reduction in length in the outer surface may result in sheer forces that help to remove debris from the outer surface. For example, such a relative reduction in length in the base surface 212 from length 352 to length 358 may result in sheer forces on the base surface 212 that help to remove debris 322 from the base surface 212.

In some embodiments, the length of the recessed surface may remain constant during a decompression of the auxetic structure. For example, as shown in FIGS. 12-15, the recessed surface 207 may remain within ten percent of the length 350 during a decompression of the auxetic structure 140. Additionally, the length of the recessed surface may remain constant while a length of the outer surface may change. For example, as shown in FIGS. 12-15, the recessed surface 207 may remain within ten percent of the length 350 while the base surface 212 changes from length 352 to length 358.

The relative lengths between the recessed surface of the auxetic structure and the outer surface of the auxetic structure may vary. In some embodiments, the length of the recessed surface is equal to the length of the base surface while in an uncompressed state. For example, as shown in FIG. 15, the length 350 of the recessed surface 207 is equal to the length 358 of the base surface 212 while in an uncompressed state. In other embodiments, the relative lengths are different during an uncompressed state (not shown).

In some instances, the sheer force may result from changes in a relative spacing between adjacent polygonal portions. For example, as shown in FIG. 12, the first polygonal portion 201 is spaced from the sixth polygonal portion 206 at the second void portion 312 by a length 360. In the example, the first polygonal portion 201 is spaced from the sixth polygonal portion 206 at the first void portion 310 by a length 362 that is smaller than length 360. Next, as shown in FIG. 13, during a first stage of uncompressing, the spacing between the first polygonal portion 201 and the sixth polygonal portion 206 expands from length 362 to length 364 at the first void portion 310. Further, as shown in FIG. 14, during a second stage of uncompressing, the spacing between the first polygonal portion 201 and the sixth polygonal portion 206 expands from length 364 to length 366 at the first void portion 310. Finally, as shown in FIG. 15, while in an uncompressed state, the spacing between the first polygonal portion 201 and the sixth polygonal portion 206 has a length 368 that is greater than length 366. In certain embodiments, such an increase in relative spacing between adjacent polygonal portions may result in sheer forces that help to remove debris from the outer surface. For example, such an increase in the first void portion 310 from the length 362 to the length 368 may result in sheer forces that help to remove debris 322 from the base surface 212.

In some embodiments, the length at the polygonal void portion may remain constant during a decompression of the auxetic structure. For example, as shown in FIGS. 12-15, length 360 at second void portion 312 during a decompression of the auxetic structure may remain within ten percent of length 360 during while in an uncompressed state. Additionally, the length at the second void portion during a decompression of the auxetic structure may remain constant while a length of the outer surface may change. For example, as shown in FIGS. 12-15, the length 360 at the second void portion 312 may remain constant while the first void portion 310 changes from length 362 to length 368.

The relative spacing between adjacent polygonal portions at the polygonal void portion and at the hinge void portion may vary. In some embodiments, the spacing between adjacent polygonal portions at the polygonal void portion and at the hinge void portion may be equal while in an uncompressed state. For example, as shown in FIG. 15, the length 360 at the second void portion 312 is equal to the length 368 at the first void portion 310 while in an uncompressed state. In other embodiments, the relative lengths are different during an uncompressed state (not shown).

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear comprising:

an upper;

an outsole having an upper surface attached to the upper and having an outer surface;

wherein the outer surface includes:

a base surface;

a plurality of protrusions extending outward from the base surface away from the upper surface;

a plurality of voids extending from the base surface toward the upper surface, wherein the plurality of voids are arranged across the base surface to provide the base surface with an auxetic structure.

2. The article of footwear according to claim 1, wherein each of the plurality of voids has a tristar pattern.

3. The article of footwear according to claim 2, wherein each void comprises a center and three radial segments extending from the center.

4. The article of footwear according to claim 3, wherein each of the three radial segments extends a common radial distance from the center.

5. The article of footwear according to claim 4, wherein each of the plurality of protrusions includes a ground contacting surface that is spaced from the base surface by a separation distance;

wherein the radial distance is 1/50 to 1/2 of the separation distance.

6. The article of footwear according to claim 1, wherein the outsole is formed of a rubber.

7. The article of footwear according to claim 1, wherein each of the plurality of protrusions has a perimeter that is a quadrilateral.

8. An outsole for an article of footwear, the outsole comprising:

an upper surface;

a base surface opposite the upper surface;

a plurality of protrusions extending outward from the base surface, wherein each of the plurality of protrusions has a respective ground contacting surface, and wherein the base surface is spaced closer to the upper surface than each respective ground contacting surface;

a plurality of voids extending from the base surface toward the upper surface, wherein each of the plurality of voids defines a respective recessed surface, and wherein each recessed surface is spaced closer to the upper surface than the base surface;

wherein the base surface and the plurality of voids cooperate to form an auxetic structure.

9. The outsole for the article of footwear according to claim 8, wherein the auxetic structure has a thickness of 1/50 to 1/2 a separation distance between the ground contacting surface and the base surface.

10. The outsole for the article of footwear according to claim 8, wherein the ground contacting surface and the auxetic structure are integrally formed.

* * * * *